US005230604A

United States Patent [19]

Glaser et al.

[11] Patent Number: 5,230,604

[45] Date of Patent: Jul. 27, 1993

[54] MULTIPLE FAN TURRET UNIT FOR USE WITHIN A TOWER UNIT

[75] Inventors: Donald L. Glaser, Akron; Ronald L. Eckstine, Seville, both of Ohio

[73] Assignee: Air Enterprises Incorporated, Akron, Ohio

[21] Appl. No.: 820,765

[22] Filed: Jan. 15, 1992

[51] Int. Cl.[5] ..... F04D 25/08; F04D 25/16

[52] U.S. Cl. ..... 415/60; 415/119; 415/211.2; 416/120; 416/142; 416/246; 454/352; 248/188.4

[58] Field of Search ..... 416/120, 121, 142, 246; 415/60, 119, 126, 211.2, 214.1, 213.1; 454/322, 346, 352, 355; 248/161, 188.4, 188.5, 188.9; 417/359, 423.15

[56] References Cited

U.S. PATENT DOCUMENTS

| | | | |
|---|---|---|---|
| 584,234 | 6/1897 | Nash | 415/60 |
| 1,427,859 | 9/1922 | Schmidt | 454/352 |
| 2,521,920 | 9/1950 | Koch | 248/161 |
| 2,812,703 | 11/1957 | Tobey | 454/352 |
| 2,837,991 | 6/1958 | De Roo | 454/322 |
| 2,981,172 | 4/1961 | Kalman | 454/352 |
| 3,901,470 | 8/1975 | Roeder | 248/161 |
| 3,947,148 | 3/1976 | Holt | 415/119 |
| 4,616,974 | 10/1986 | Andruszkiw et al. | 416/142 B |
| 4,747,857 | 5/1988 | Andrews . | |
| 4,876,951 | 10/1989 | Vork | 454/322 |
| 5,014,608 | 5/1991 | Benson et al. . | |

FOREIGN PATENT DOCUMENTS

| | | | |
|---|---|---|---|
| 830180 | 1/1952 | Fed. Rep. of Germany | 416/121 A |
| 19930 | 2/1980 | Japan | 416/142 B |
| 54678 | 4/1980 | Japan | 416/142 B |

*Primary Examiner*—Edward K. Look
*Assistant Examiner*—James A. Larson
*Attorney, Agent, or Firm*—Reese Taylor

[57] ABSTRACT

A self-contained fan turret unit for use with a tower air recirculating system includes a housing positionable for attachment to the tower system. The housing includes an extendable column assembly bearing a turret assembly to which are attached one or more fans, inlet bells and discharge cones with the turret assembly being movable from a position within the housing to one above the housing by the column assembly. The turret is supported by an air spring isolator and, when extended, is connected to the housing and the tower unit by flex joint isolators. A cowling is also provided for releasable attachment to the turret. The turret is rotatable and extendable arms are provided to interconnect the column assembly and the fans for selective removal thereof from the turret.

62 Claims, 24 Drawing Sheets

MULTIPLE FAN TURRET UNIT FOR USE WITHIN A TOWER UNIT

BACKGROUND OF THE INVENTION

This invention relates in general to tower air recirculation units for use in clean rooms or the like and relates in particular to a simplified, self-contained fan turret unit for use within a tower recirculation unit which is capable of being fully factory-assembled, sealed and shipped to the point of ultimate use where it may be installed with minimal additional on-site labor required.

DESCRIPTION OF THE PRIOR ART

It is well-known that clean rooms present a very desirable environment, particularly in manufacturing or research facilities such as, for example, those wherein high technology, precision, mechanical or electrical components are assembled. Likewise, such environments are desirable in the pharmaceutical and biotechnology areas and, in general, any place where a particularly clean environment is sought. Such clean rooms are generally provided by the creation of pressurized air and the recirculation of large volumes of air by means of one or more fans wherein the air within the room is conditioned and the environment controlled to prevent contaminated air from entering the room. Some examples of apparatus and systems of the general type used to accomplish these objects can be seen in Andrews U.S. Pat. No. 4,747,857 and Benson U.S. Pat. No. 5,014,608.

As will be appreciated by those knowledgeable in the art, in addition to the above, there are a number of such systems for recirculating air including installations such as, for example, ones in which the recirculating unit is disposed upon the commonly used high efficiency particulate air filters or where the unit is disposed on top of the clean rooms themselves. While generally satisfactory, such installations require a fairly large number of fans, are difficult to service and present difficulties in returning the air.

There are also systems which employ what are known as tower units which are particularly useful in relatively large rooms, commonly known as "ballrooms," and which are disposed on or below the floor of the room so as to pick up the recirculated air at or below floor level and deliver it either directly to a pressure plenum or to duct work leading to the high efficiency particulate filters.

The use of such tower units also provides the advantage of disposing water, electrical, steam, condensate and other connections from above the clean room ceiling to at or below floor level of the clean room itself.

Systems of this type come in many forms, but generally include one or more of the tower units, the components of which are fabricated at a factory site and then shipped to the point of use, whereupon the components are assembled in place and connected to the clean room via the building high efficiency particulate duct system or plenum and the air return system or plenum. While these types of installations are effective for the purposes for which they are designed, a number of difficulties are commonly encountered.

The most common difficulties are the amount of on-site labor required for installation and the necessity of cleaning the various components after shipping and installation. It is also necessary to install external supporting steel to support the fans and components and, commonly, these installations require a relatively larger amount of space. It is, therefore, felt desirable to provide a self-contained unit which can be fully assembled in a factory, sealed and quickly and simply installed at the building site.

Additionally, conventional tower units generally include one or more fans. The use of multiple fans provides the advantage of redundancy such as, for example, when a system design calls for two fans and three are provided so that, most likely, two will always be available. Such an arrangement also provides for flexibility in that the system can be operated at less than full capacity if desired. However, in conventional construction, the fans are, of course, installed at the job site which is labor intensive and costly.

Furthermore, these fans are normally mounted on support columns in each instance and are provided with isolation canvases or flexes which generally comprise two per fan and which have the unintended or undesirable effect of inhibiting fan performance and efficiency. It is, therefore, desirable to reduce the number of flexes and to additionally provide an inflatable flex which provides greater sealing properties and is attached to the structure of the turret assembly and not to fans themselves which, in effect, removes the flex from direct contact with the air flow.

Conventional construction also generally involves the utilization of four rubber and shear, prestressed kinetics, springs or air isolators per fan to isolate against vibration and it is thought desirable to reduce the number of isolators and provide only one per tower, supporting the turret, thereby reducing cost and simplifying construction operation and change out.

Conventional construction also often involves the installation of isolation dampers. There is a tendency in such construction to encounter pressure drops, inefficiencies, and leaks around the damper blades and the dampers are difficult to install and maintain. Such construction is thus relatively expensive and not totally satisfactory in operation, and it is believed to be desirable to provide internal dampening means at the factory and independently for and in each fan. Further, such dampers occupy less space, have fewer operating parts and are more accessible for repair, replacement and adjustment.

It is furthermore often a problem that the tower units are installed close together in the ultimate setting due to space restrictions. The difficulty is that the fans will often require maintenance or repair and it is usually necessary to shut down and essentially disassemble the tower unit in order to gain access to the fans for these purposes. It is, therefore, felt desirable to provide a means by which individual fans can be readily, quickly and efficiently removed from their operative position for repair, maintenance or replacement. This, coupled with the redundancy previously mentioned, makes it possible to maintain the tower unit itself in operation while servicing or replacing a given fan.

It will also be seen that providing all of the fans on the rotatable turret assists in the fan removal operation and eliminates the need for large amounts of structural steel as is the case when the fans are externally mounted.

Many of the desirable features just mentioned are of a nature which facilitate off site assembly and a consequent reduction in on site time and expense. Many, however, also result in a greatly improved unit regardless of whether assembled on or off site.

SUMMARY OF THE INVENTION

The advantages set forth above have been found to be obtainable by providing a self-contained fan turret unit for use within a tower unit for use in clean rooms or the like.

It is, therefore, an object of the invention to provide such a unit comprising an enclosed main housing and an extendable support column mounted centrally of the housing and connected to the base of the housing. The extendable support column is movable between retracted and extended positions and supports a rotatable turret assembly carrying the fans, inlet bells, discharge cones and perimeter seals which is carried on the projecting end thereof, whereby the turret assembly can be moved from a position beneath the top wall of the main housing for shipping purposes and to a position above the top wall or roof of the main housing for connection with the upper portion of the tower unit at the job site. Such an arrangement makes it possible to assemble the fans, coils, filters, sound alternators, etc., clean them and shrink wrap or otherwise seal the entire section at the factory, thereby allowing them to remain sealed and thus reducing the likelihood of contamination prior to the start of operation.

It has further been found that, in accordance with the above object of the invention, fan removal arms, attachable to the support column, can be provided between the column and the fan housings so as to permit individual fans to be quickly and easily swung out of their operative position into an accessible position for ready access thereto when necessary for maintenance or replacement without inactivating the other fans.

In accordance with the above object of the invention, it has also been found that the column can be mounted so that it can be adjusted to accommodate uneven floor surfaces beneath the column and provide the column in a true vertical condition. This allows the tower to meet very low or critical levels of vibration and effectively and efficiently meet seismic requirements.

In accordance with the above object of the invention, it has also been found that a single air spring or isolator can be provided per column to isolate all of the fans mounted on the turret, thereby reducing manufacturing costs and simplifying maintenance. The single isolator also avoids the problems of controlling deflection and torsional isolator movement common when multiple fans are each provided with their own isolator. This also eliminates installation difficulties. With a single isolator, deflection can be maintained at a predetermined level so that maximum isolation efficiency can be obtained regardless of how many fans are running at a given time or no matter what load they are operating under.

In accordance with the above object of the invention, it has also been found that air flow can be improved by providing a further single inflatable isolator for the entire turret to seal against air leakage between the turret and the upper and lower sections of the tower unit itself and between the turret and the housing.

In accordance with the above object of the invention, it has been found that on-site assembly costs and time can also be reduced by providing internal, cam operated, two position dampers in each discharge cone. Such dampers, provided internally of each fan, reduce leakage, have fewer operating parts and are more accessible for repair, maintenance and adjustment.

Finally, in accordance with the above general object of the invention, it has been found that utilization of the turret structure enables the entire turret assembly to be jacketed or encased by a removable cowling to isolate breakout sound from the rotating fans.

Accordingly, production of an improved self-contained fan turret unit for use within a tower unit for use in clean rooms or the like of the character above-described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
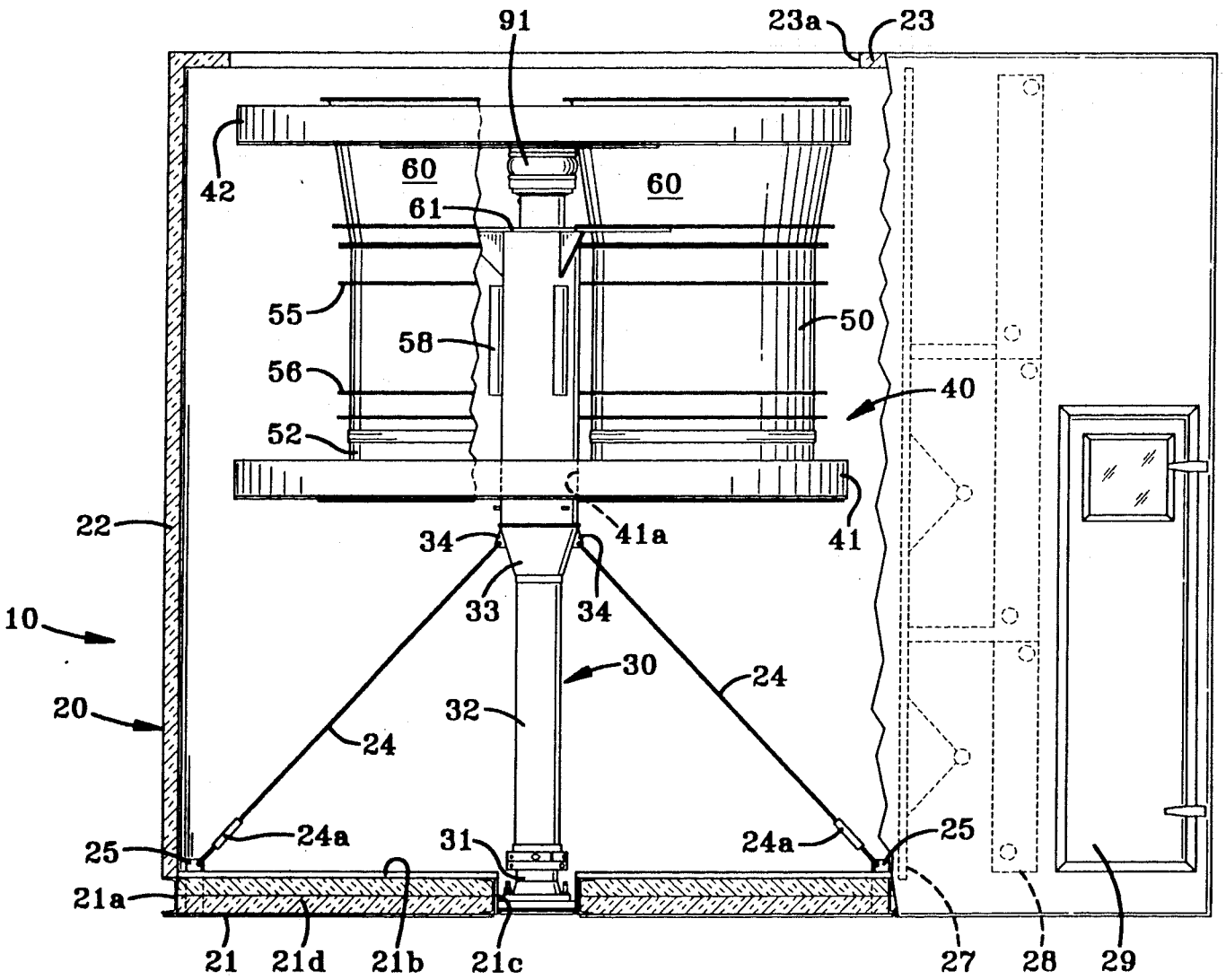
FIG. 1 is an elevational view partially in section showing the fan turret assembly of the tower unit in the retracted or shipping condition.
Figure 1A:
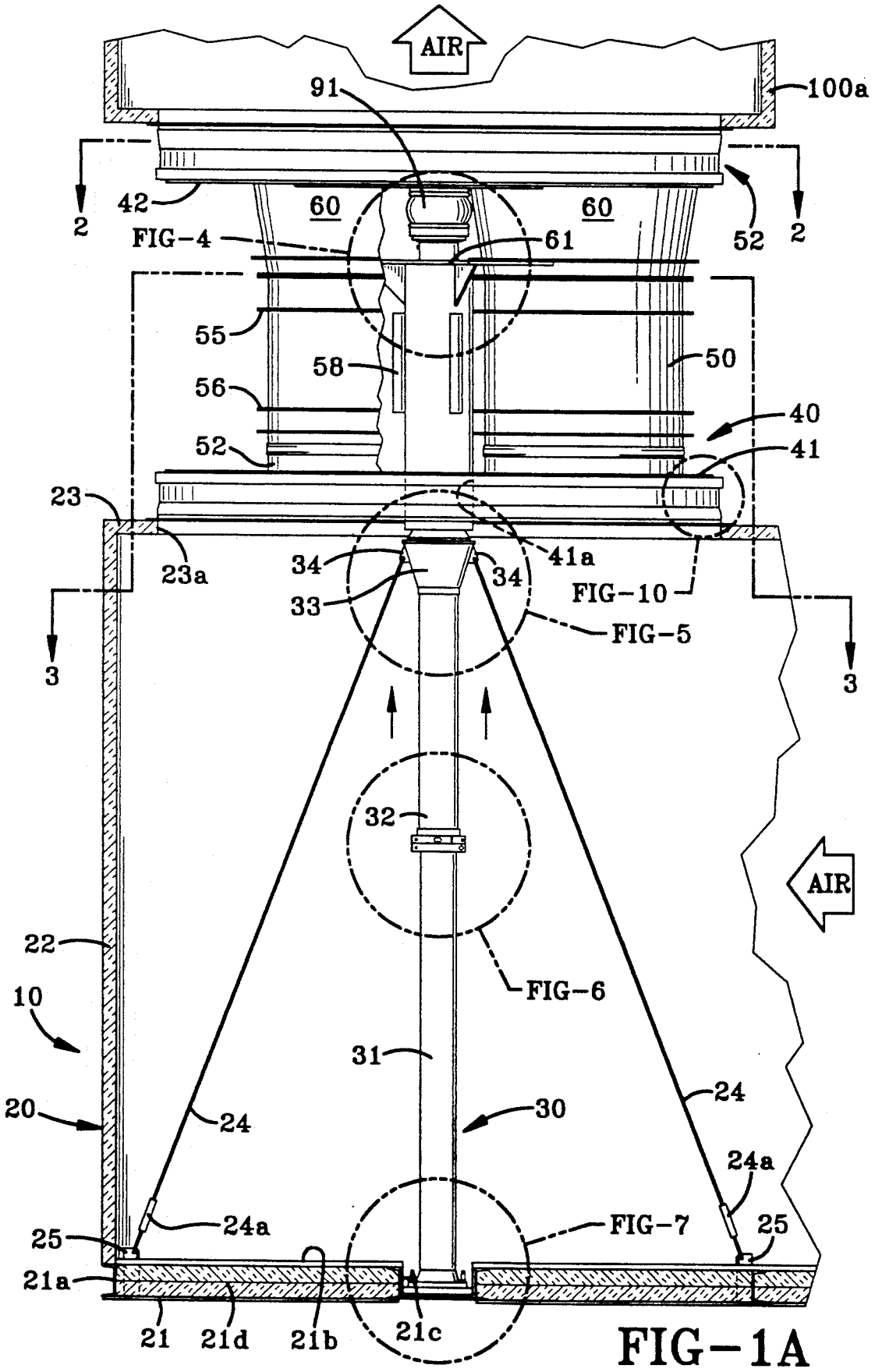
FIG. 1A is an elevational view similar to FIG. 1 showing the fan turret assembly elevated to the operative position and connected to the upper tower structure.

Referring first then to FIGS. 1 and 1A of the drawings, it will be seen that the self-contained tower unit, generally indicated by the numeral 10, includes a main housing 20, an extendable column assembly 30, and a turret assembly 40 containing the fan and cone assembly comprised of the fan units 50,50 and discharge cones 60,60. These main assemblies will each be described in detail below. It should be noted here, however, that FIG. 1 generally illustrates the unit in its retracted, transportation mode while FIG. 1A illustrates the unit in its extended, installed and operating mode.

Main Housing 20

Still referring to FIGS. 1 and 1A, it will be seen that the main housing, generally indicated by the numeral 20, includes opposed sidewalls 22.22 which can be characterized as either four sidewalls or opposed sidewalls and opposed front and rear walls. In any event, a generally cube-shaped structure is provided as the main housing 20. That structure further includes a unit pan assembly or floor 21 and a top wall or roof 23, the top wall or roof 23 having a through aperture 23*a* in it for air flow and extension of the fan and cone assembly therethrough as the unit is moved from the FIG. 1 mode to the FIG. 1A mode, as will be explained below.

Figure 3:
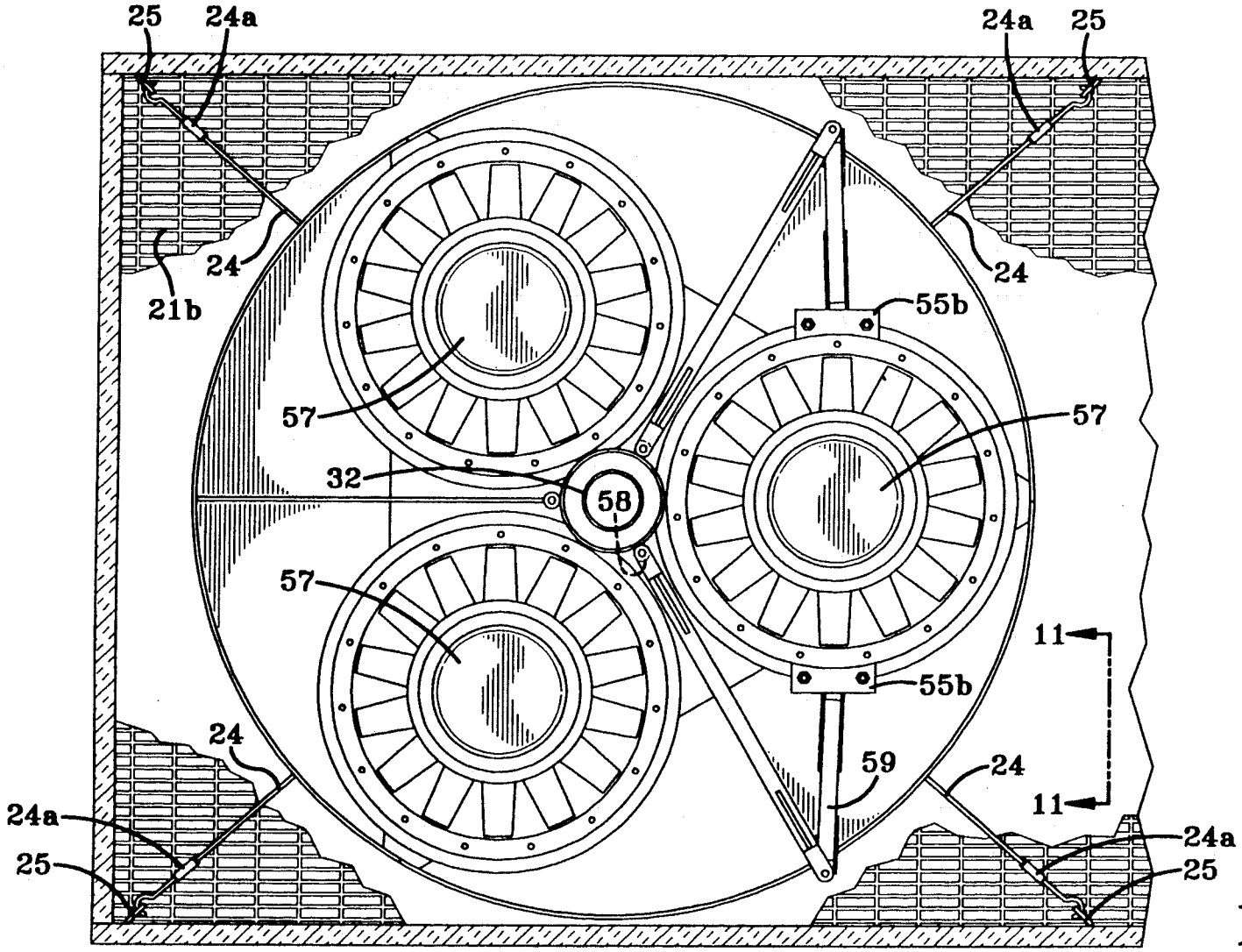
FIG. 3 is a sectional view taken along the line 3—3 of FIG. 1A and showing the fans in their operative position.

The unit pan assembly 21 includes a number of channels 21*a* forming a framework and serving as appropriate cross braces, all covered by a perforated skin or gate 21*b* (see, for example, FIG. 3). Suitable insulation and sound absorption material 21*d* is also provided beneath grate 21*b* and is supported on a bottom plate 21*e* (see FIG. 7).

Also secured to the perimeter channels 21*a* of unit pan assembly or floor 21 are guy rod anchor lugs 25,25 to which are attached a plurality of guy rods 24,24 with their associated turnbuckles 24*a*,24*a* and which are utilized to provide stability to the assembly during shipping and installation. These guy rods are thus anchored to unit pan assembly or floor 21 and to the column assembly 30, as will be described more fully below.

The unit pan assembly or floor 21 also has a through opening 21*c* framed by channels 21*f*,21*f* and mounting plates 21*g*,21*g* (see FIGS. 7 and 7A) for receipt of the column base plate 31*b* and footprint plate 31*c*, the function of which will be described below.

Also schematically illustrated in FIGS. 1 and 1A are associated apparatus such as a humidifier 27, coils 28 and an access door 29, all of which are common to tower units and required to completely condition the air which moves in the direction of the labelled arrows of FIG. 1A. FIG. 1A also illustrates the upper portion of the tower unit 100*a* to which the fan turret unit is connected upon installation as shown.

The result is a self-contained unit 10 which, in the FIG. 1 mode, can be completely fabricated, assembled and sealed in the factory and then shipped to its point of end use and installed expediently and with a minimum of on-site labor, material and expense.

Column Assembly 30

As previously noted, it is a feature of the invention to provide for preassembling and sealing as much of the apparatus as possible at the point of manufacture. To that end, a novel column assembly 30 has been provided so that, upon shipment and location of the unit 10 below the upper portion of the tower unit 100*a* (see FIG. 1), it is a relatively simple matter to raise the column assembly 30, connect to the upper portion of the tower unit 100*a* and place the overall unit in operation. That column assembly will now be described.

Still referring primarily then to FIGS. 1 and 1A of the drawings, it will be noted that the column assembly 30 includes a lower column section 31 and an upper column section 32, the projecting end of which receives a turret support 33. The turret support 33 has a plurality of guy rod attachment brackets 34,34 secured thereto so that the guy rods 24,24 can have one end attached to the anchor lugs 25,25 and the other end attached to the brackets 34,34, as can be clearly seen in FIGS. 1 and 1A of the drawings. As previously noted, this guy rod arrangement provides stability during shipment and installation.

Figure 7:
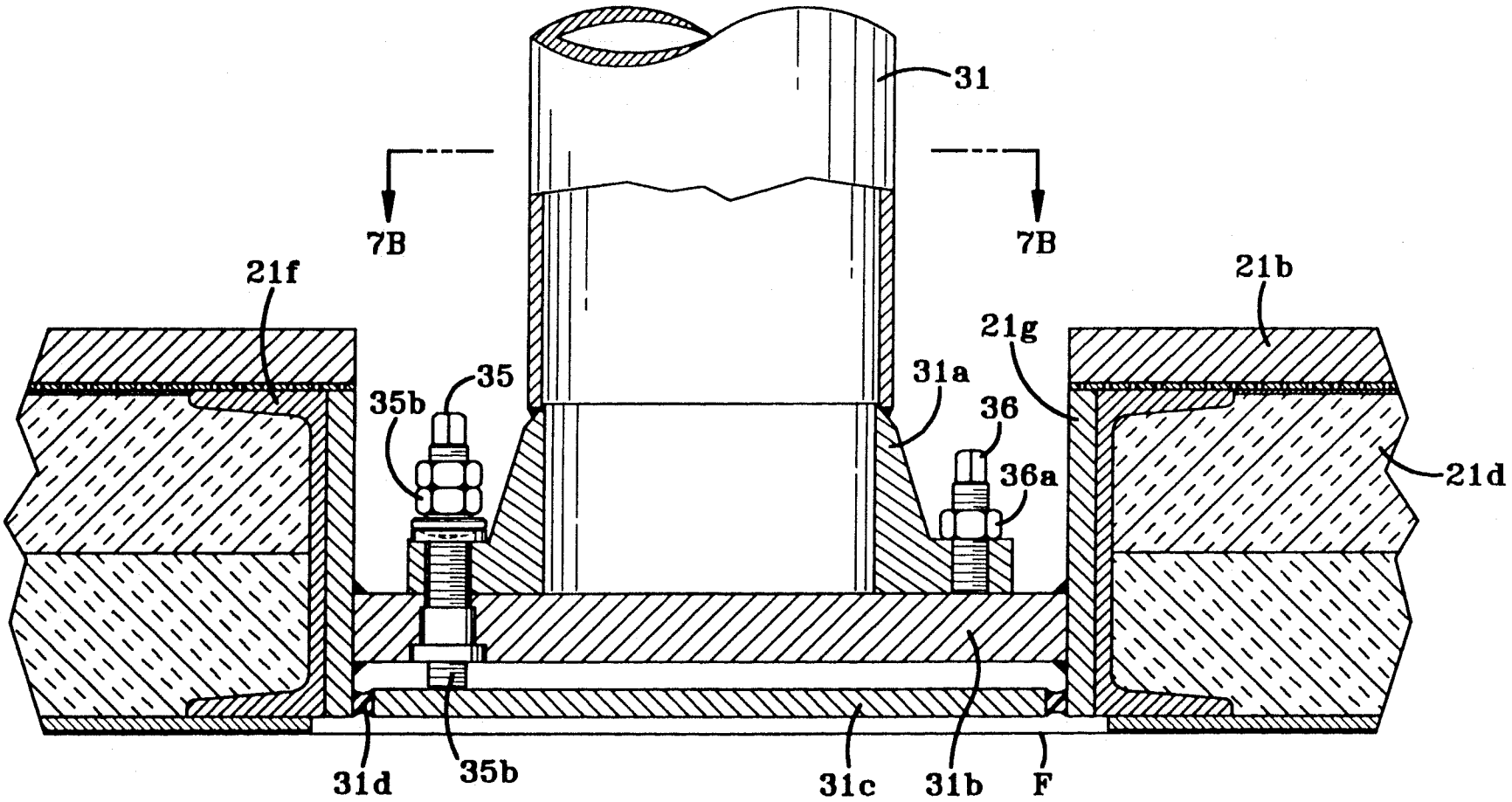
FIG. 7 is an enlarged view, partially in section, showing the base mounting and levelling structure for the column.
Figure 7A:
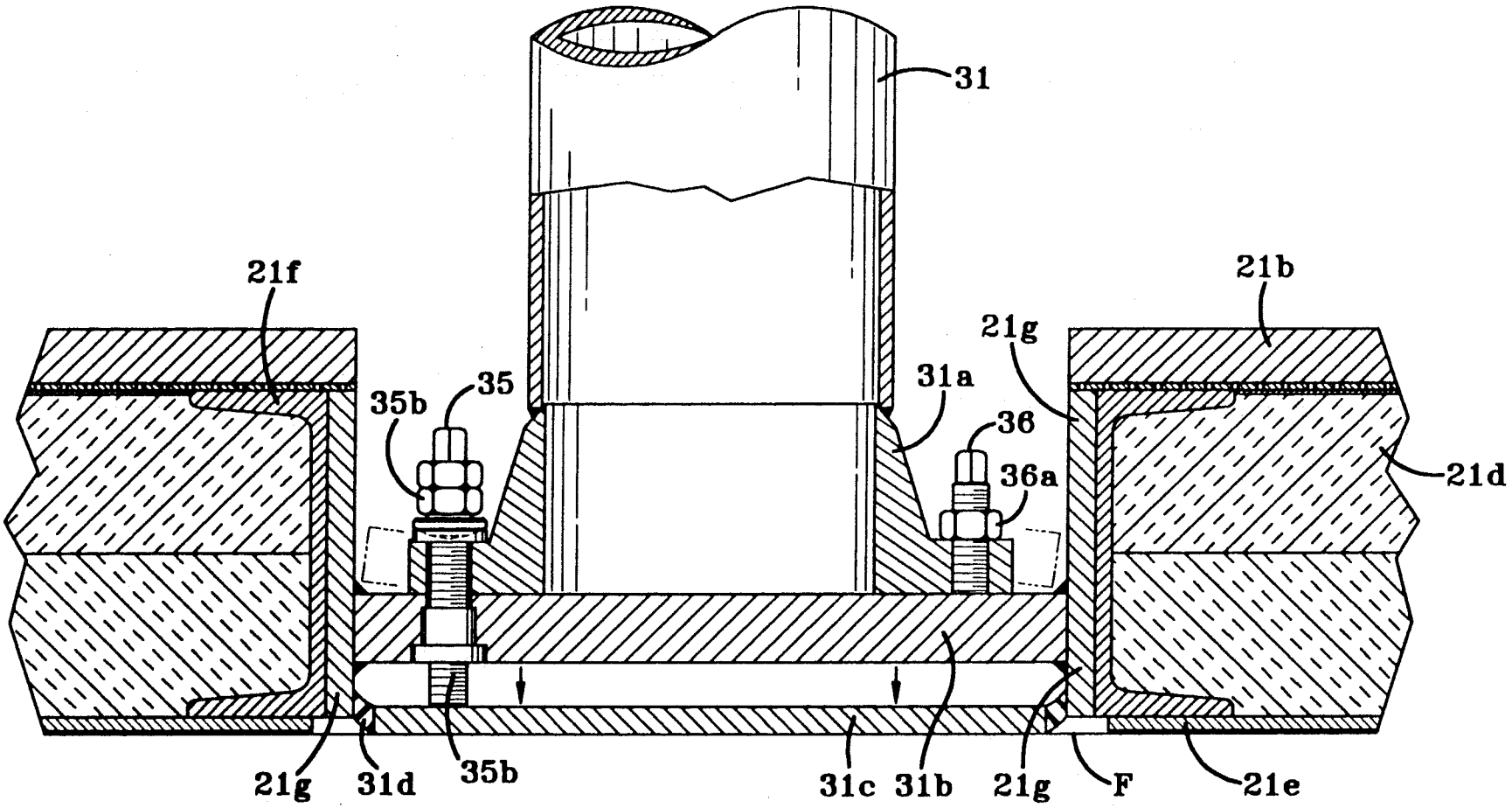
FIG. 7A is a view similar to FIG. 7 showing the base mounting and levelling structure following activation.

With further regard to the support column assembly 30, it will be understood that one end of the lower column section 31 is telescoped within upper column section 32. As can be seen in FIGS. 7 and 7A, the remaining end of the lower column section 31 is secured by welding or otherwise to a column support flange 31*a* which is, in turn, bolted to a base plate 31*b* by one or more first, threaded adjustment studs 35. This base plate 31*b* is received in the previously referred to opening 21*c* in the unit pan assembly or floor 21 and welded or otherwise secured about its periphery to mounting plates 21*g*,21*g*, and the various adjustment studs and nuts, which will be described more fully below, permit leveling of the column relative to the floor F of the building in which the unit is installed so that irregularities in the mounting surface can be accommodated as well as permitting the column assembly 30 to be disposed in a true vertical condition.

Figure 7B:
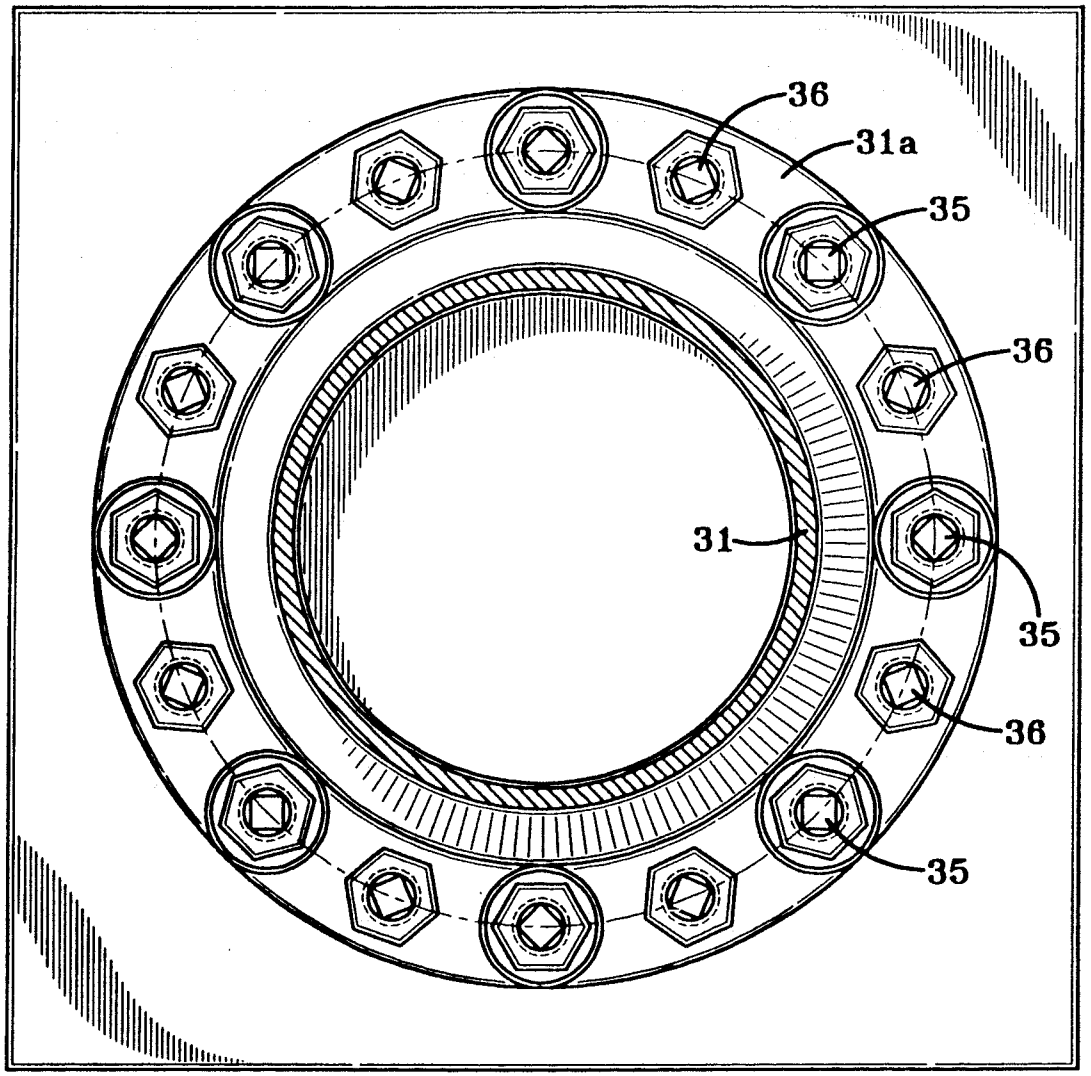
FIG. 7B is a sectional view taken along the line 7—7 of FIG. 7.

In that regard, as can be seen in FIGS. 7 through 7B, a series of first adjustment studs 35 pass through support flange 31*a* and base plate 31*b* and bear against footprint plate 31*c* so that plate 31*c* may be forced down against the floor F of the building even if the floor F should be lower than the bottom plate 21*e* of unit pan assembly or floor 21 in that area. It will be noted that footprint plate 31*c* is adjustably mounted by being secured to the perimeter mounting plates 21*g*,21*g* of opening 21*a* by a flexible connection 31*d* made of silicone or a similar material.

It will also be noted that a series of second levelling studs 36 and jam nuts 36*a* are provided and pass through the support flange for use in plumbing the column assembly 30 as will be described.

It is contemplated that, for levelling purposes, the jam nuts 36*a* would be loosened, following which first levelling studs 35 and jam nuts 35*a* would be activated to force footprint plate 31*c* against floor F using spherical, flanged nut and washer assembly 35*b*, thereby making it possible to level base plate 31*b*. The column assembly 30 can then be plumbed by suitable adjustment of second levelling studs 36,36 and jam nuts 36*a*,36*a*. It will be noted that the use of spherical, flanged nuts and washer assemblies 35*b* insures that the original registry with floor F can be maintained even if column support flange 31*a* is cocked during plumbing of column assembly 30 as shown in chain-dotted lines in FIG. 7A.

Figure 6:
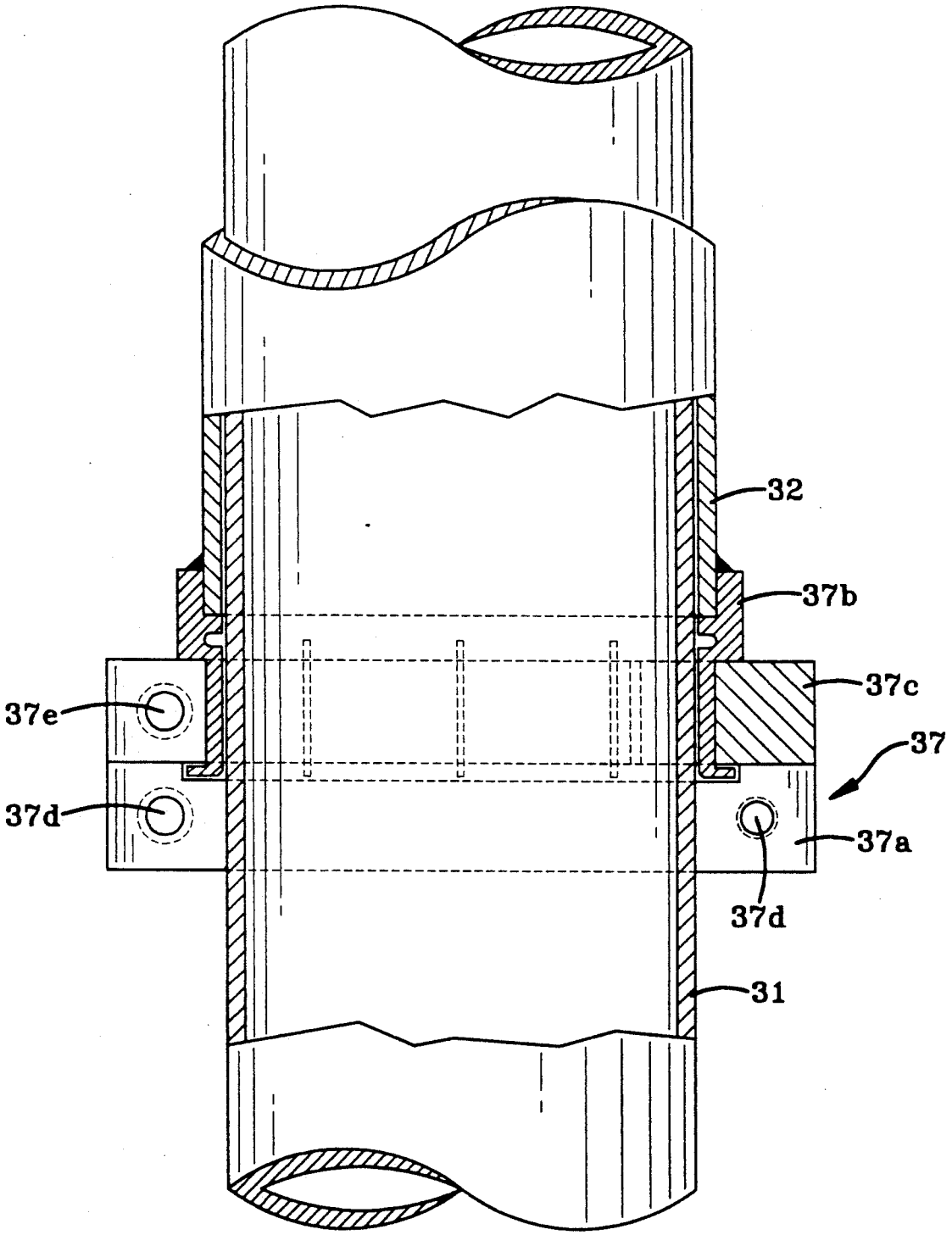
FIG. 6 is an enlarged elevational view, partially in section, showing the coupling of the upper and lower column sections.

Referring again to FIGS. 1 and 1A, it will be seen that upper column section 32 is telescoped over lower column section 31 and the two sections are connected by a guide and locking collar assembly 37 (see FIG. 6) which includes a two-piece locking collar 37*a*, a collet guide 37*b* and a three-piece locking collar 37*c*. The two-piece locking collar 37*a* is attached to lower column section 31 and secured by bolts 37*d*,37*d* which draw the pieces thereof together about the column section. The upper edge of collect guide 37*b* is secured by welding or otherwise to upper column section 32 and three-piece locking collar 37*c*, which is also collapsible, engages the collapsible lower portion of collect guide 37*b* when bolts 37*e* are tightened.

Also received in the top of lower column section 31 is a piston 31*f* (see FIG. 5) with the usual O-ring seals in the appropriate grooves (not shown) so as to provide a fluid-tight seal within upper column section 32.

As previously noted, the upper column section 32 telescopes over the lower column section 31 and carries a turret support 33 as well as guy rod brackets 34,34 which are welded to the exterior of the upper column section 32.

The upper end of upper column section 32 receives a column cap 32*a* (see FIG. 4) which serves as a seat for a bearing assembly and air spring which make it possible to rotate the entire turret assembly 40 and which will now be described.

Figure 4:
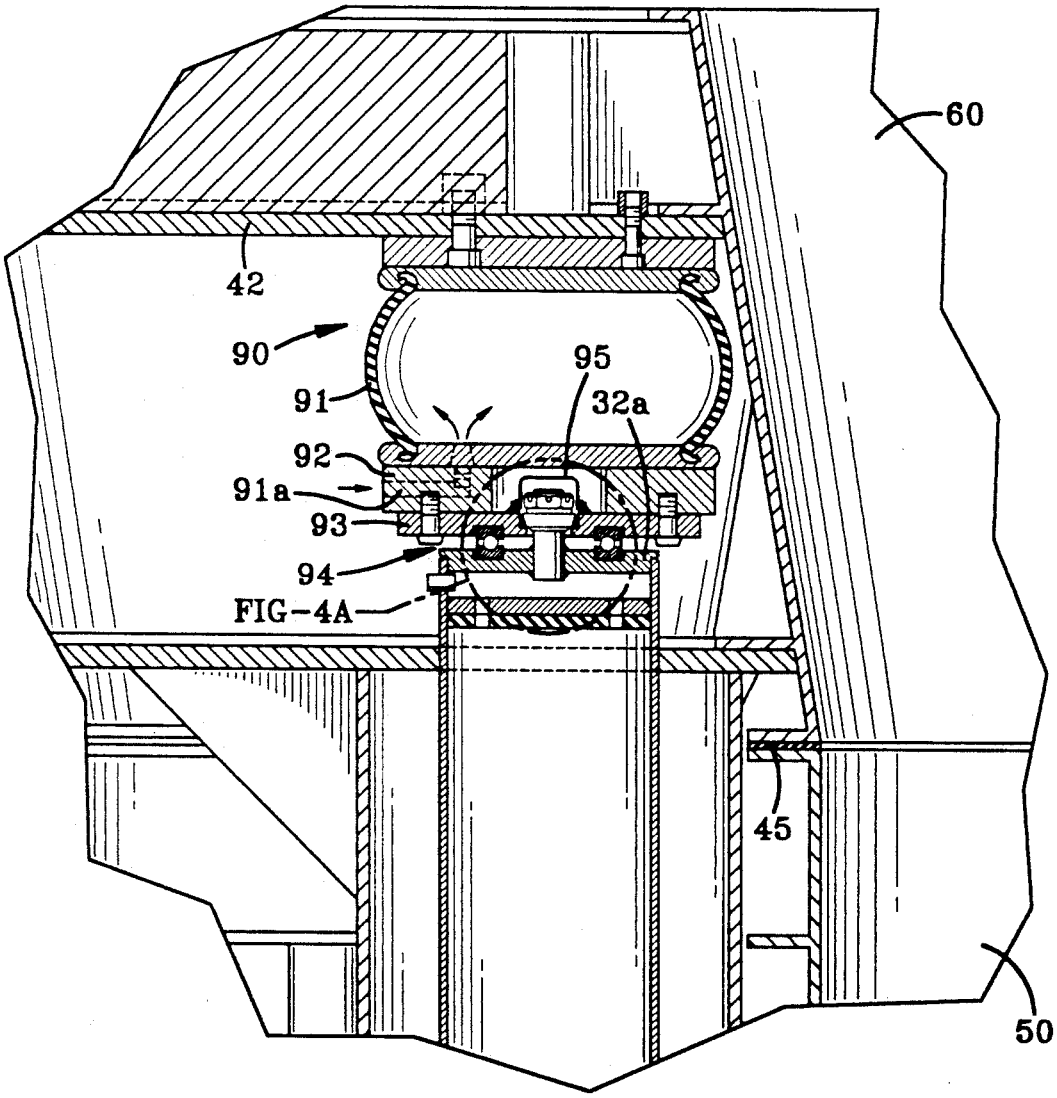
FIG. 4 is an enlarged elevational view, partially in section, showing the air spring structure.
Figure 4A:
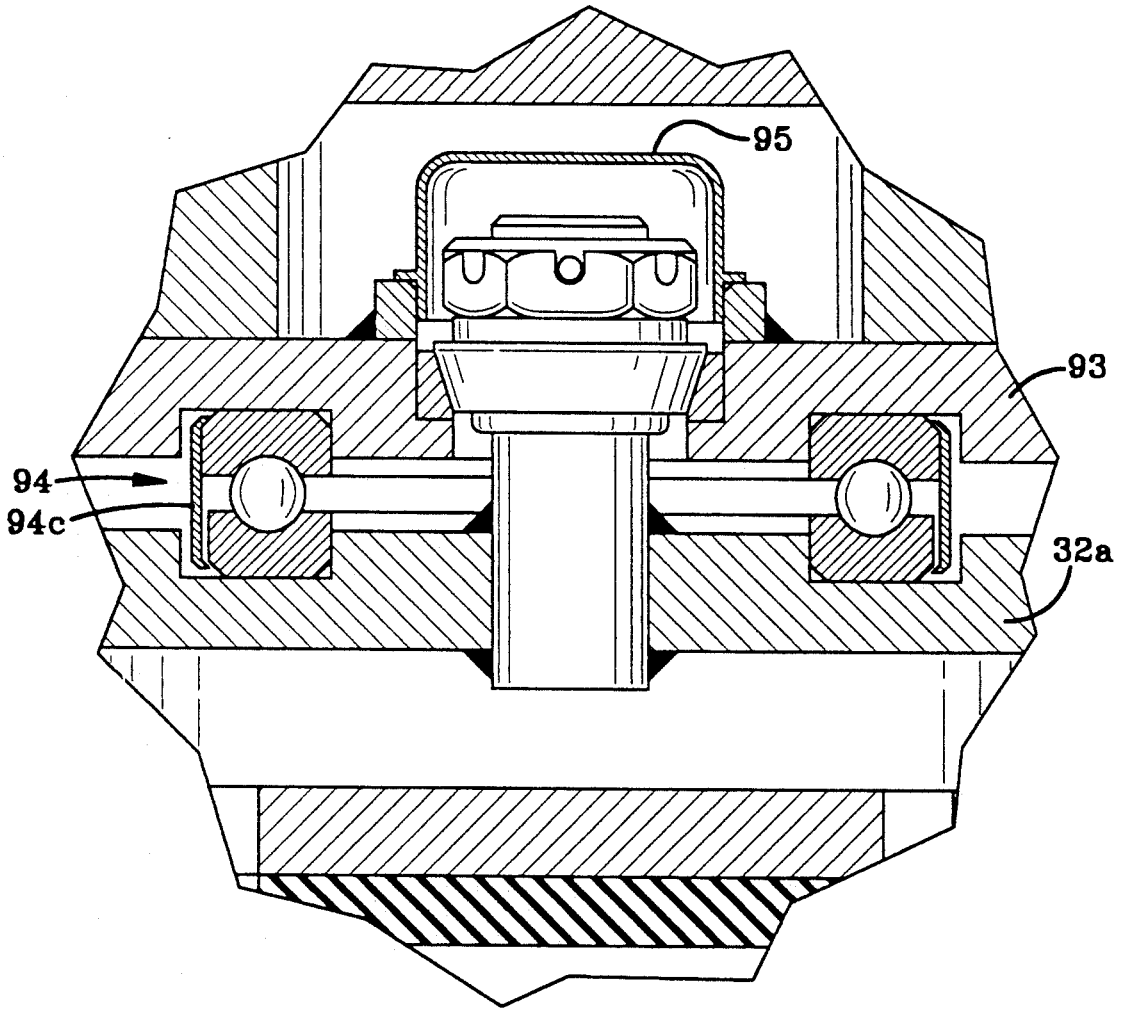
FIG. 4A is a further enlarged elevational view, partially in section, of the structure of FIG. 4.

FIGS. 4 and 4A show the air spring assembly 90 which includes the air spring 91, with suitable air supply means 91*a*, and the air spring pedestal 92 to which the air spring 91 is secured in known fashion. The air spring pedestal 92 is, in turn, received on an air spring bearing plate 93 which is mounted on a thrust bearing 94 received on column cap 32*a* so that the turret assembly and the air spring 91 rotate on the top of the column and relatively thereto. It will be seen that a bearing cap 95 and a dust shield 94*a* are also provided so as to avoid any fouling of the bearing during operation. It will also be noted that only one air spring 91 is required for the entire unit and that the air spring serves as a vibration isolator for all of the fans. It also is used to raise and lower the turret off of and on to its support 33 and to control the operational height thereof.

It will be seen, then, that the column assembly 30 is capable of movement from its retracted or shipping position to its extended or operational position in keeping with one of the objects of the invention—to provide a transportable, preassembled unit.

To still further accomplish that object, the turret assembly 40 is mounted on column assembly 30 as will now be described in detail.

The Turret Assembly 40

Figure 5:
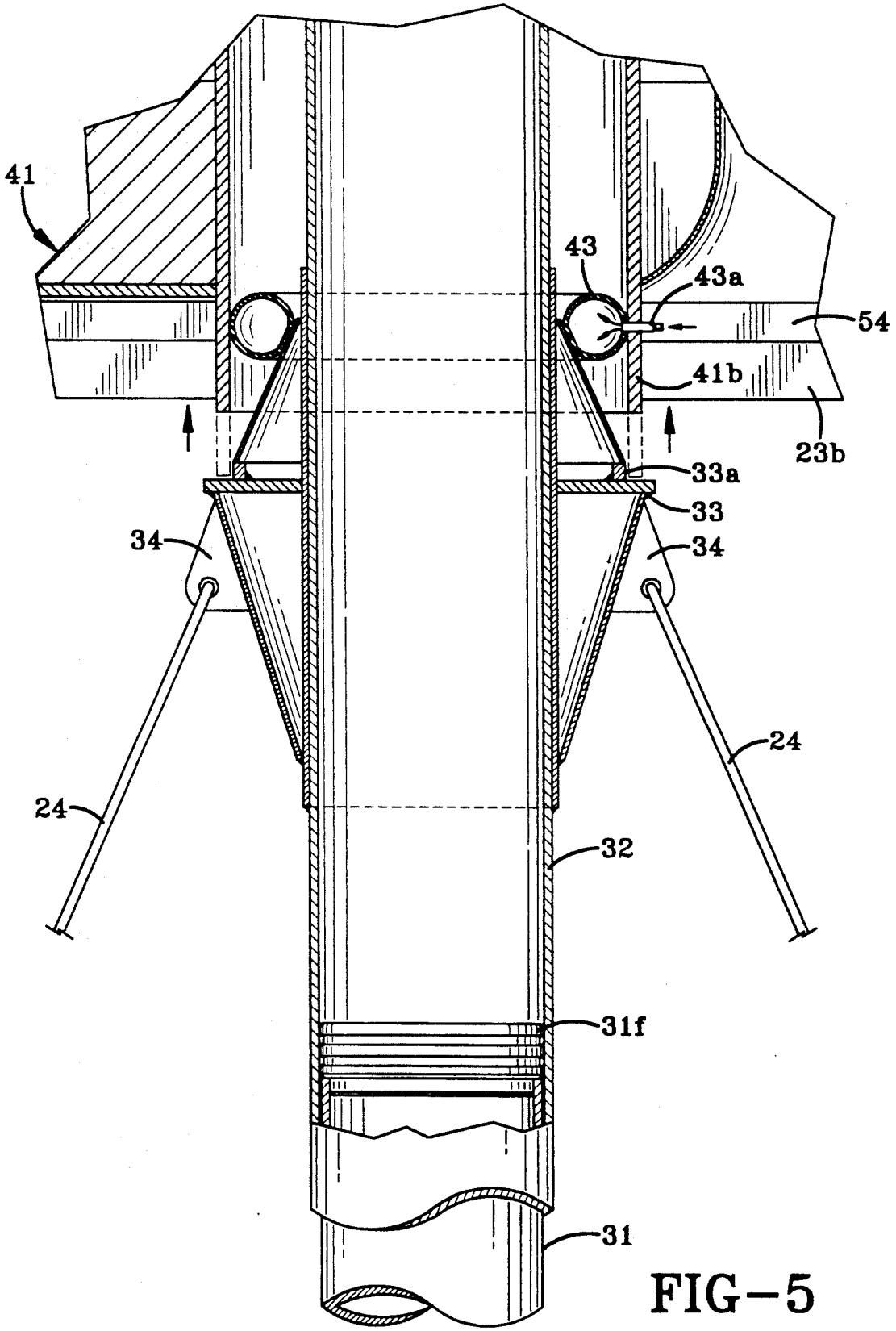
FIG. 5 is an enlarged elevational view, partially in section, showing the disposition of the turret support and the turret assembly.

The turret assembly 40, which carries the fans and their associated cone assemblies, includes a lower turret substructure 41 shown resting on the top of the turret support 33 in the broken lines in FIG. 5 and movable therewith as the telescoping upper and lower column sections 31 and 32 are moved between the retracted position of FIG. 1 and the extended position of FIG. 1A. An upper turret substructure 42 is also provided and rests on air spring 91. It will be noted that discharge cones 60 are bolted or otherwise secured to upper turret substructure 42 while the fan inlet bells 50*a* are carried by lower turret substructure 41.

The upper column section 32 extends through an opening 41*a* in lower substructure 41 and through turret sleeve 41*b*, terminating in column cap 32*a* beneath the air spring 91 mounted on the lower surface of upper substructure 42. As can be seen in FIG. 5, an inflatable seal 43 is disposed about the outside of upper column section 32 and inside the turret sleeve 41*b* of substructure 41 to block off air flow in the center section. This seal 43 can be inflated through one or more fittings 43*a* which are connected to a suitable air supply.

Also, as can be seen from FIGS. 1 and 1A, the turret assembly 40 includes the upper and lower substructures 41 and 42 and the discharge cones 60,60 which are bolted thereto to provide a foundation to support the fans 50,50 which are, in turn, bolted to the discharge cones by suitable bolts (not shown). It will be noted from FIG. 4 that an annular elastomeric gasket 45 may be inserted between the mating flanges of the fan housings and cones to compensate for irregularities therein when the fan housings are secured to the discharge cones.

Figure 10:
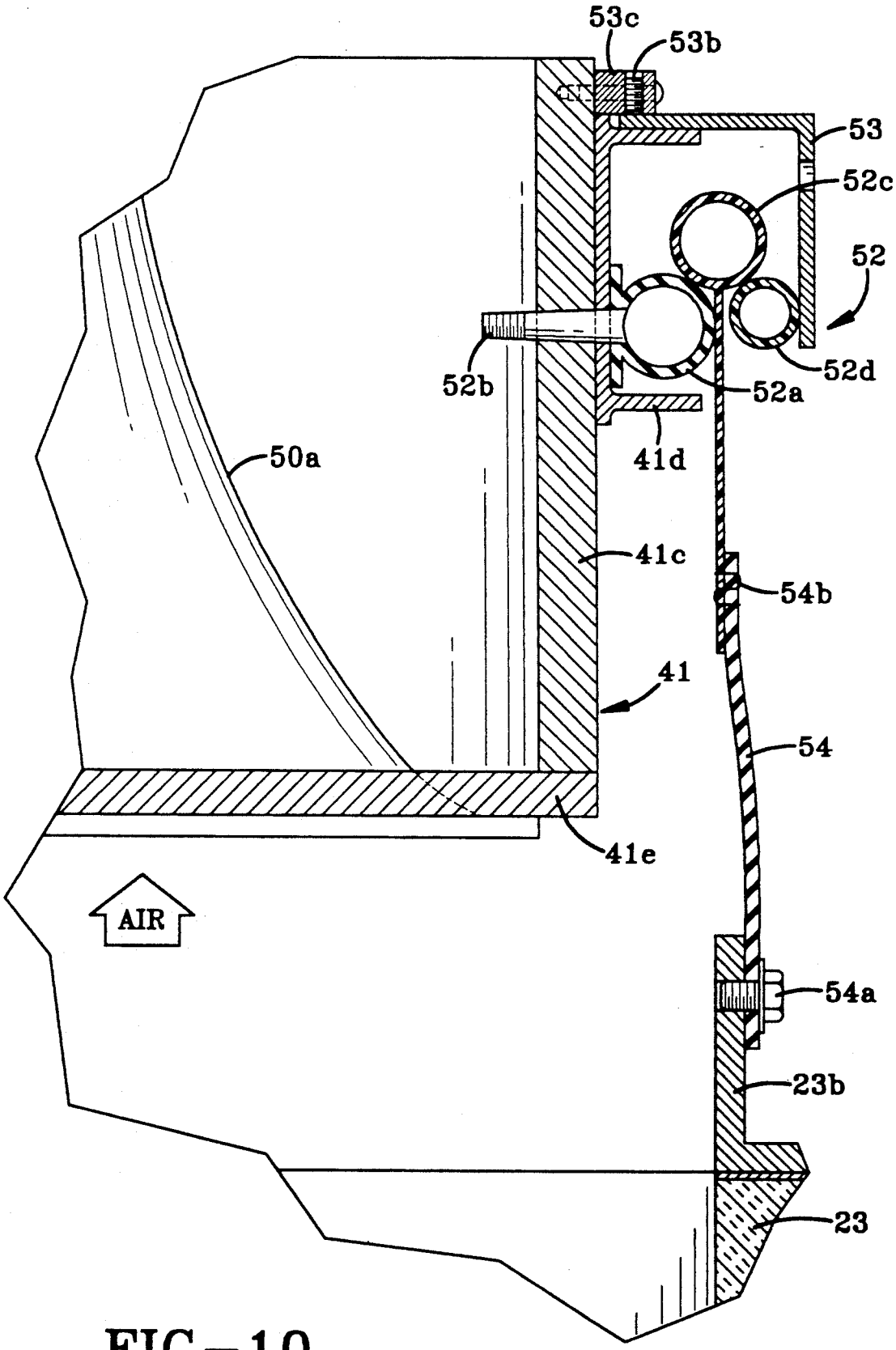
FIG. 10 is an enlarged elevational view showing the isolator means.

Referring to FIG. 10 of the drawings, it will be seen that a flex joint or isolator 52 is disposed about the lower substructure 41 during installation to form a seal between the housing 20 and the turret assembly 40. This flex joint includes an inflatable O-ring type structure 52*a* which has an air fitting 52*b* which passes through the annular outer flange 41*c* of lower substructure 41. It also includes a tadpole-like extrusion 52*c* and a collapsible ring 52*d*. An annular channel 41*d* is secured around outer flange 41*c* and an angle ring 53 is secured to the channel 41*d* by means of set screw 53*b* carried by projection 53*c* on the wall of the substructure flange. As can be seen by comparing FIGS. 10 and 10A, inflation of the member 52*a* will cause the tadpole-shaped extrusion 52*b* to be compressed and a complete seal to be achieved around the periphery of the outer ring 41*c* of lower substructure 41 so as to provide an airtight seal in this area.

It will be seen that the seal is completed by providing an annular flange 23*b* mounted on top wall or roof 23 and a flexible canvas sheet 54, one end of which is secured to the flange 23*b* by a series of screws 54*a* and the other end of which is stitched, as at 54*b*, or otherwise secured to the tail of tadpole-shaped extrusion 52*c* so that, upon inflation of extrusion 52*b*, a complete seal is effected around the bottom of turret assembly 40.

It will be understood that a similar flex joint is employed to seal the top of turret assembly 40 to the upper portion of the tower unit 100*a*. In that instance, essentially the arrangement shown in FIG. 10 would be inverted and, rather than flange 23*b* being secured to top wall or roof 23 of housing 20, a similar flange would be secured to the upper portion of the tower unit 100*a*.

As can be seen from the drawings, each housing fan unit 50 has an upper fan removal ring 55 and a lower fan removal ring 56 as well as fan 57. Inlet bells 50*a* of the fans are received on the base plate 41*e* of lower substructure 41 as previously mentioned.

It will thus be seen that a turret assembly 40, which receives the fan units 50, inlet bells 50*a* and cones 60, is capable of preassembly, sealing and shipment in keeping with one of the objects of the invention. It is also capable of being raised and lowered as a unit as well as being rotated as a unit. Still further features of the invention will now be described.

The Damper Assembly 70

Figure 8:
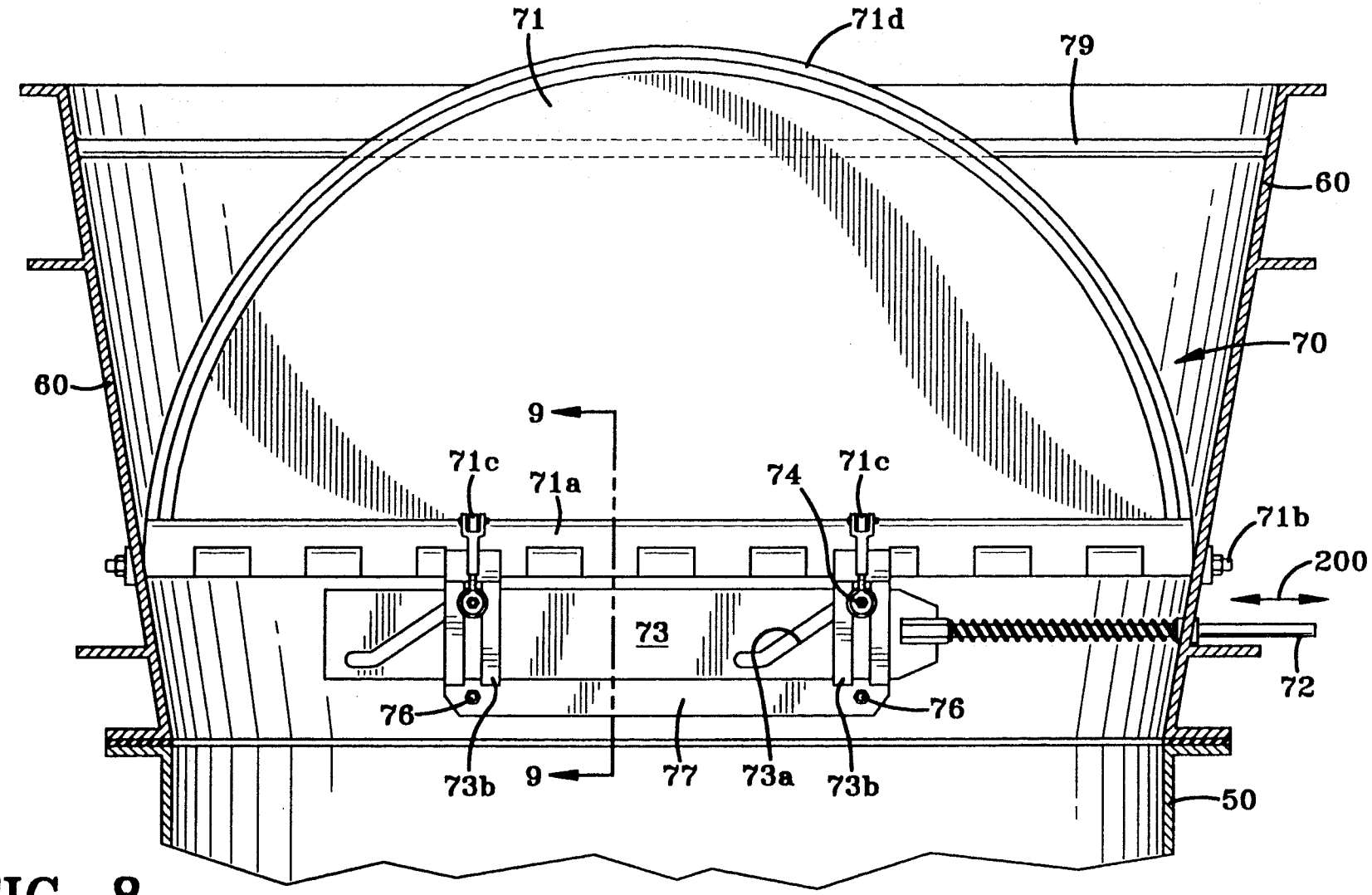
FIG. 8 is an enlarged elevational view, partially in section, taken along the line 8—8 of FIG. 2 showing the damper mechanism.
Figure 9:
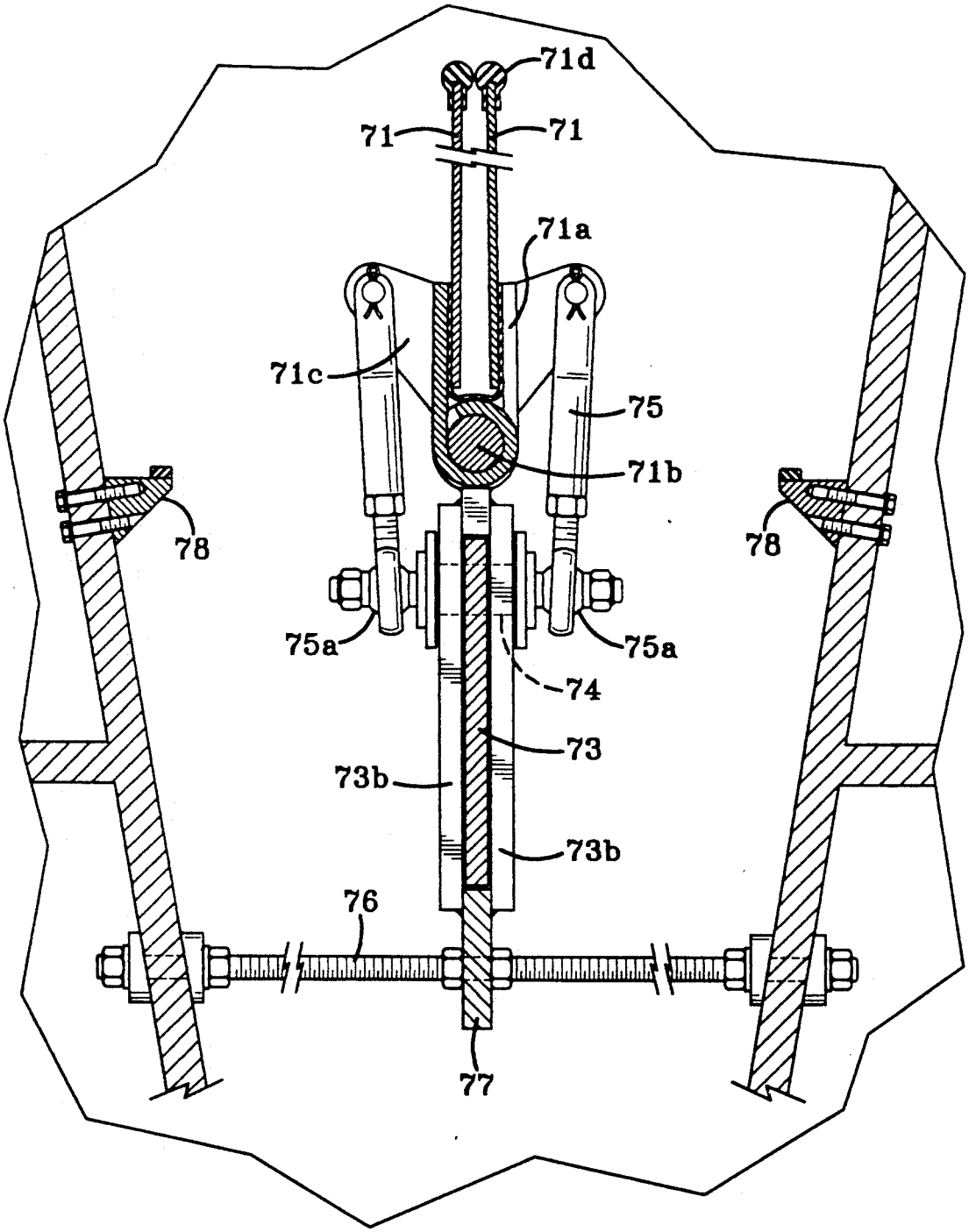
FIG. 9 is a sectional view taken along the line 9—9 of FIG. 8 showing the damper structure in fully open position.
Figure 9A:
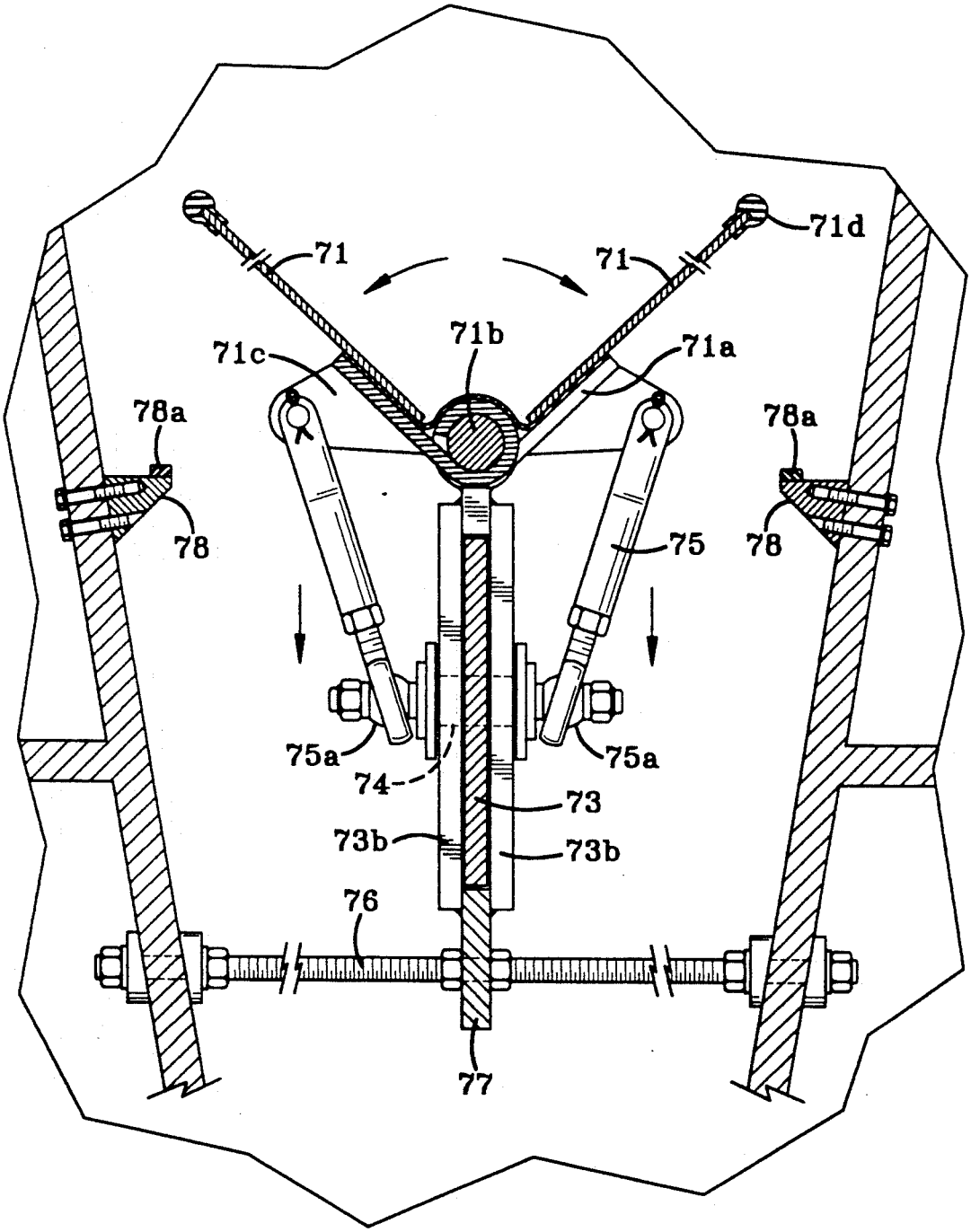
FIG. 9A is a sectional view similar to FIG. 9 showing the damper structure in the partially closed position.
Figure 9B:
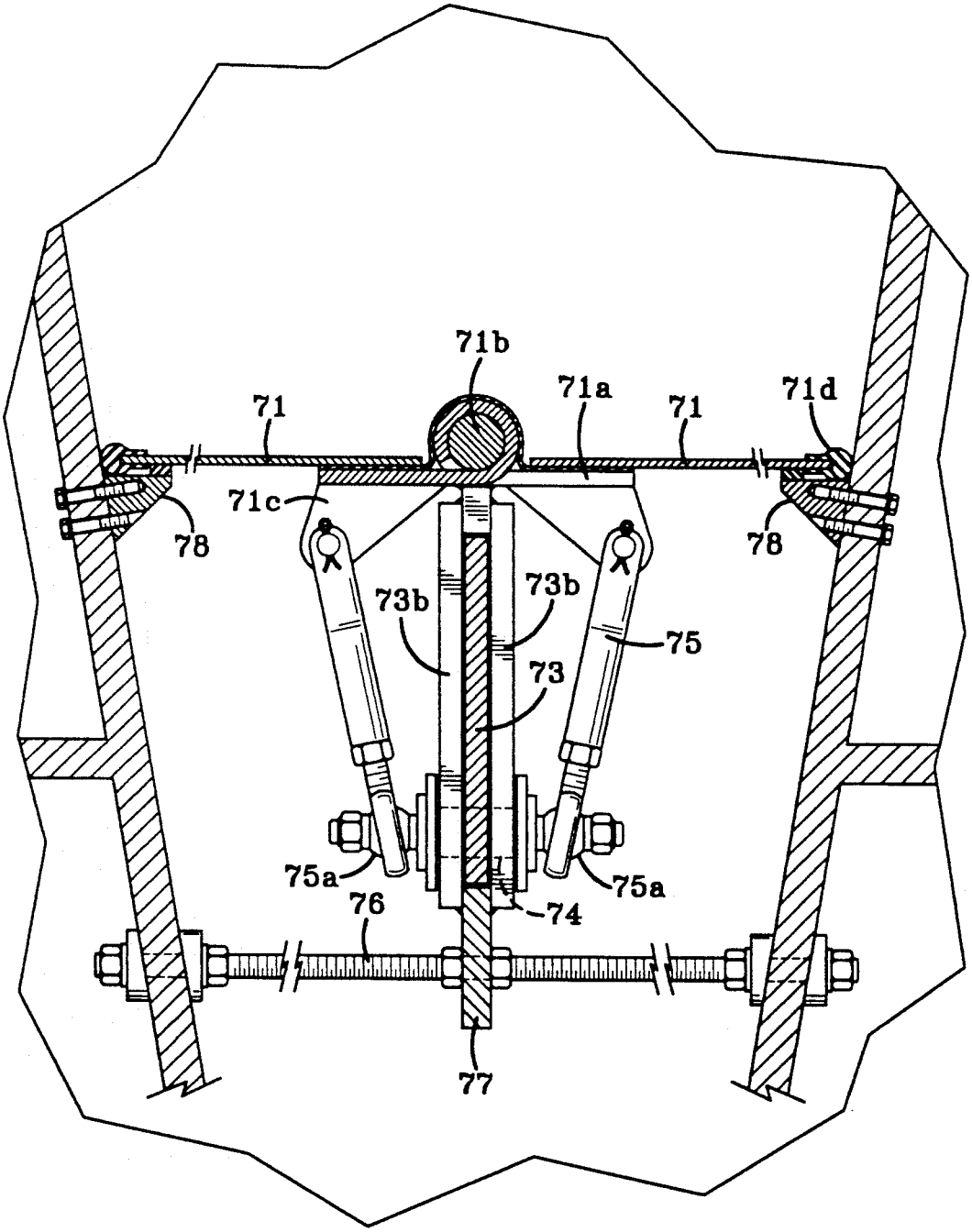
FIG. 9B is a sectional view similar to FIGS. 9 and 9A showing the damper assembly in the fully closed position.

Next, referring to FIGS. 8 through 9B of the drawings, it will be seen that a two position damper assembly 70 is received within each of the unit discharge cones 60 and provides a means for stopping air flow through non-operating fans 50 or during removal of one or more fans with the system operating and prevents back flow from the upper tower structure. Each damper assembly includes opposed butterfly-type blades 71,71 which are welded or otherwise secured to a piano-type hinge 71*a*.

This hinge 71*a* is mounted on damper hinge pin 71*b* which extends between and is supported by the walls of the unit discharge cone 60, as can be seen in FIG. 8. A slider assembly is also suspended by mounting hanger lugs 71*c*,71*c* on the hinge 71*a*. The slide plate 73 is suspended from the hanger lugs 71*c* and has a pair of three-step angular slots 73*a* milled therein and an actuating handle 72 projecting from one end through the wall of cone 60. Two guide brackets 73*b*,73*b* are mounted on each side of the slide plate 73 and a roller 74 passes through the guide bars and the slide plate 73.

Connected to opposite ends of each roller 74 is an adjustable connecting linkage 75 which interconnects the damper blades 71,71 and rollers 74. The entire assembly is stabilized by threaded rods 76 which pass through a support plate 77 and engage the walls of the cone 60.

It will be seen that spring-loaded operating arm 72 is connected to slide plate 73 so that movement of arm 72 and plate 73 in the direction of arrow 200 will cam the rollers 74 along slots 73*a* and, through connecting linkages 75, will open or close the damper blades 71,71 as desired. It will be noted that the adjustable connecting linkages 75 are each mounted, at one end, on a ball 75*a* so that they may rotate and swivel about various axes of the ball around the ball as the slider plate moves.

It will also be noted that the sealing properties of the damper assembly can be further improved by providing an edge cap 71*d* which can be fabricated of spongy, elastomeric material and which will engage the inner wall of the cone 60 when the damper is closed. The edge cap 71*d* has a bulbous end and bifurcated legs which engage the edge of blades 71 as can be seen in FIG. 9. For further improved sealing, supports 78,78 are mounted on the wall of cone 60 to support the closed damper, as can be seen in FIG. 9B and rod 79 is provided to support the opened damper. It will be seen that elastomeric stops 78*a* are received on supports 78 and that, when the blades 71,71 are in the FIG. 9B position, an effective seal will be achieved.

Figure 2:
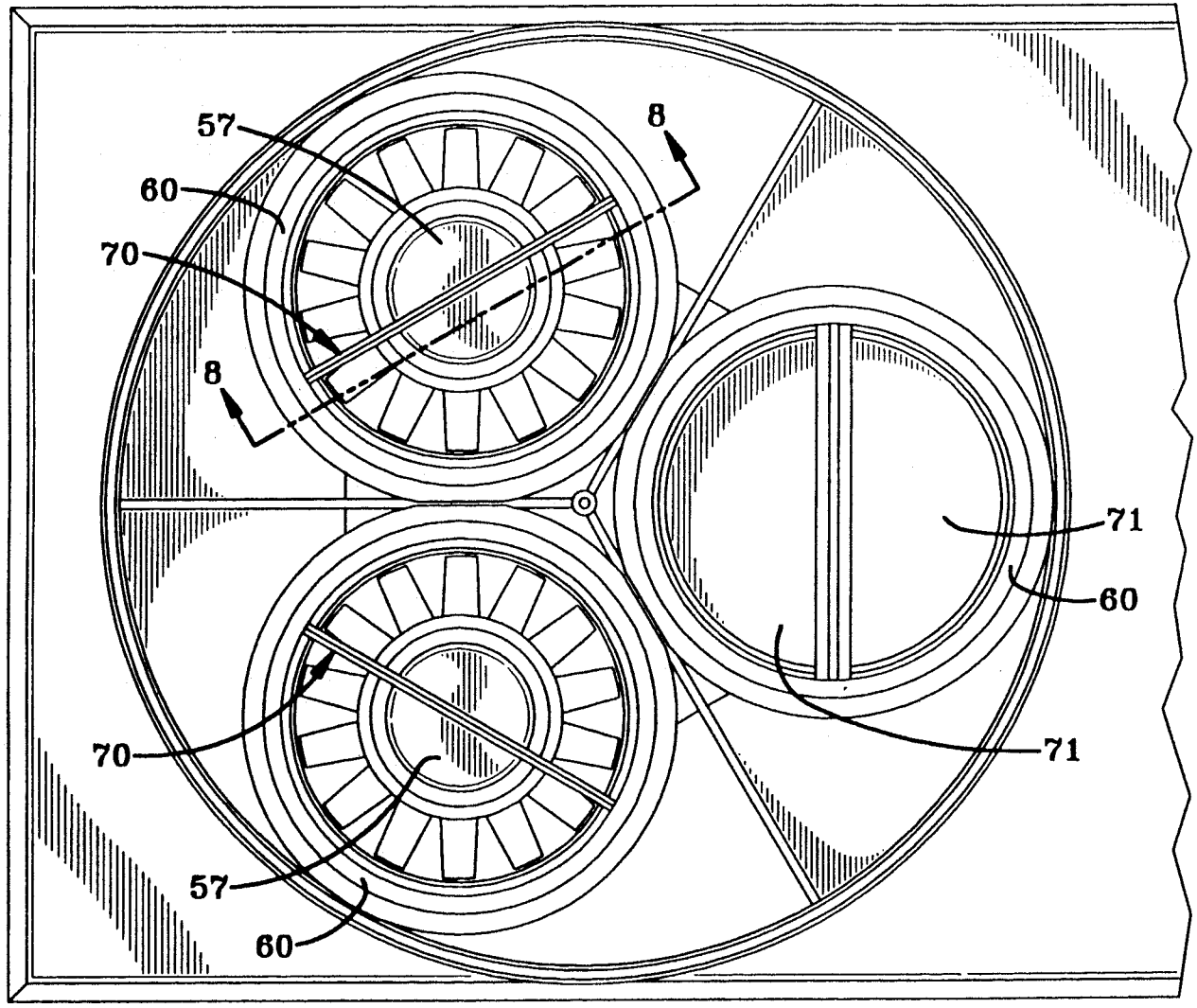
FIG. 2 is a top plan view taken along the line 2—2 of FIG. 1A.
Figure 3A:
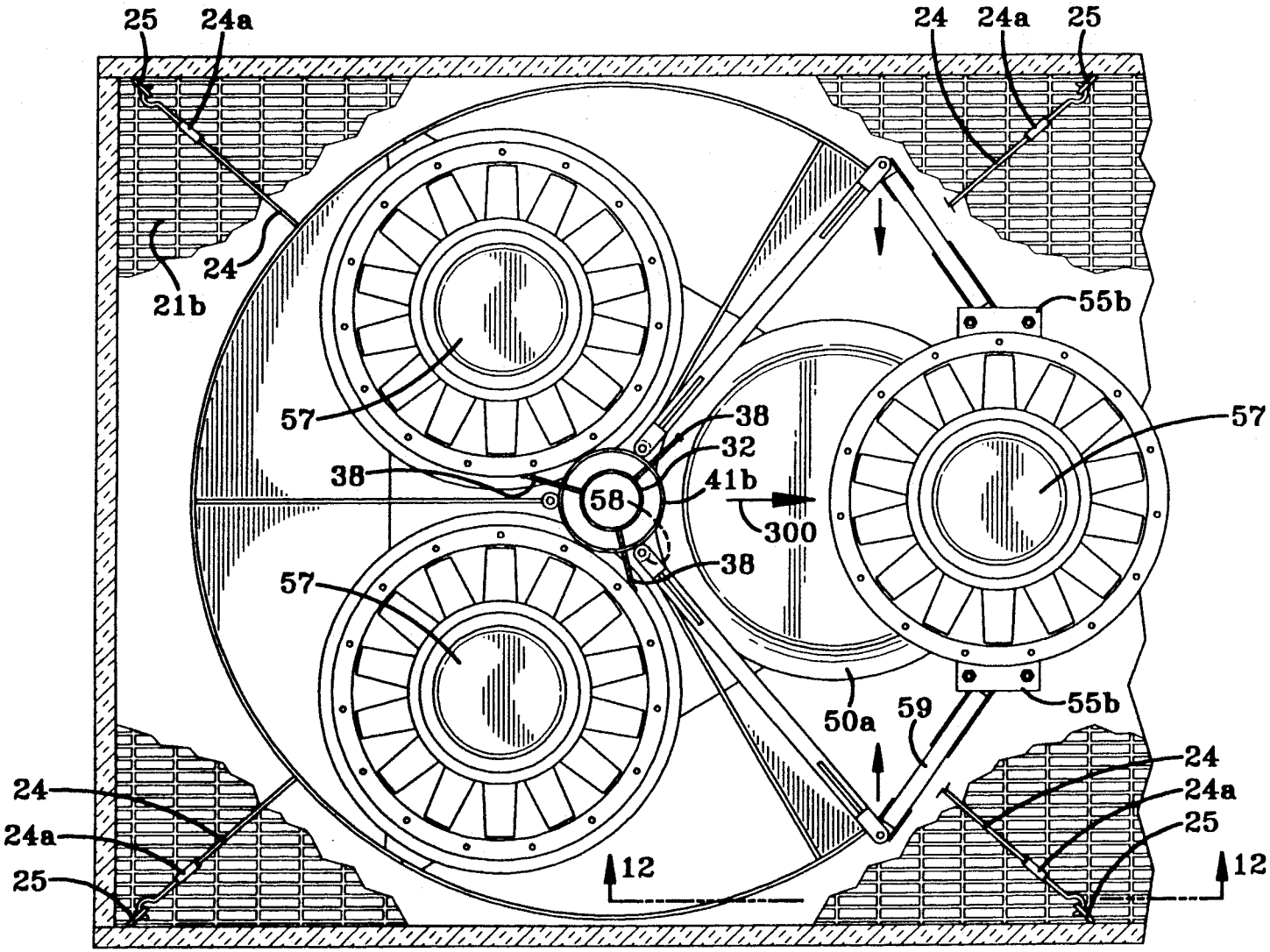
FIG. 3A is a view similar to FIG. 3 showing one of the fans partially moved out of its operative position toward its repair or replacement position.
Figure 3B:
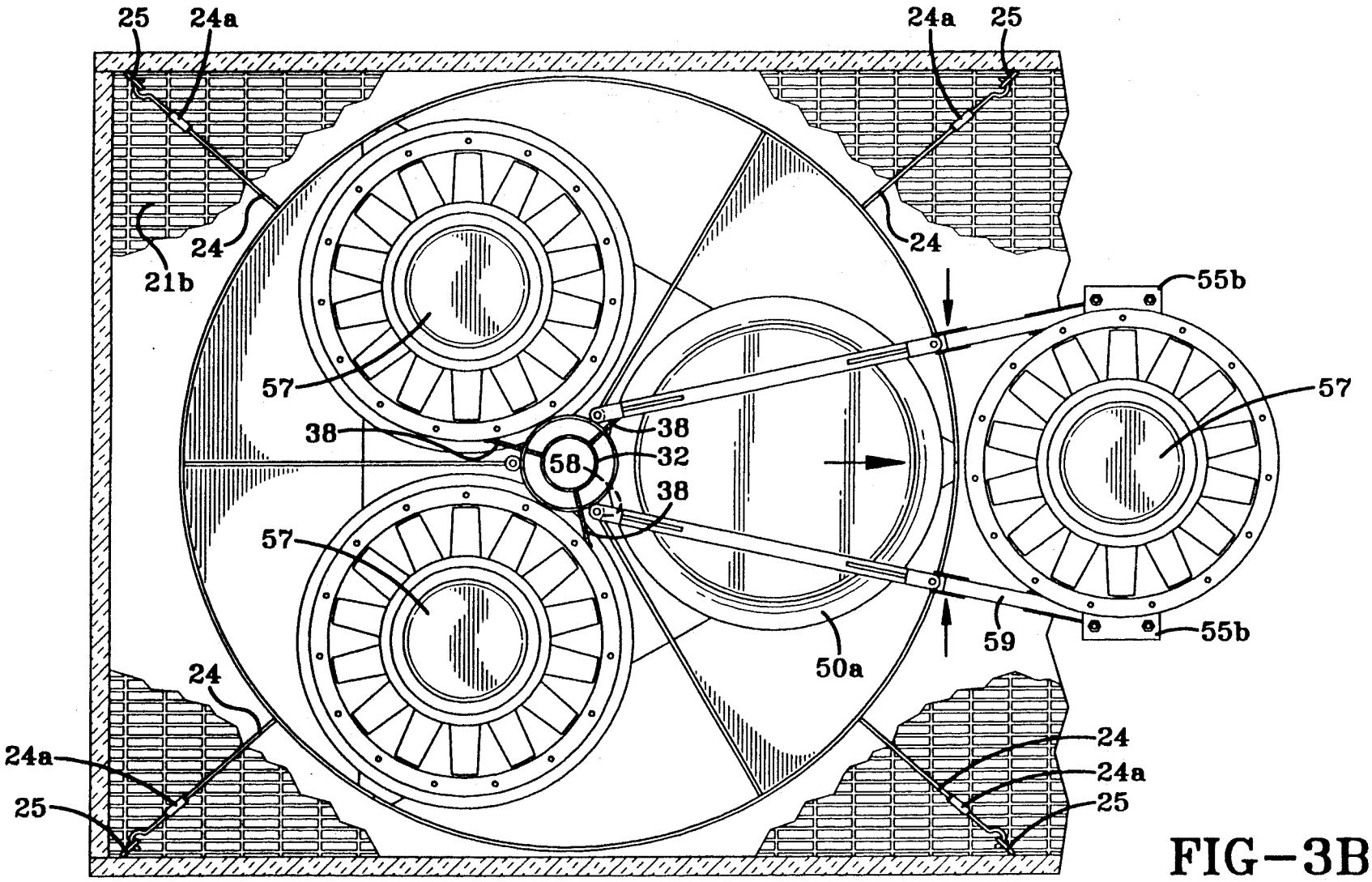
FIG. 3B is a view similar to FIG. 3A showing one of the fans in its full outward position.

Referring to FIGS. 2 through 3B, it will be seen that each damper assembly is received within the flared or evased unit discharge cone 60 and, as previously noted, is movable between the closed position seen on the assembly at the top of FIG. 2 of the drawings and in FIG. 9B and the open position shown in the bottom two fan installations of FIG. 2 of the drawings and in FIGS. 8 and 9, as previously described.

The Fan Removal System

As previously noted, it is often the case that banks of tower units of the nature involved in this application are arranged in fairly close proximity to each other and it is, therefore, sometimes difficult to obtain access to the fan units for service, repair or replacement of the same. Also, in some instances, personnel may not service the fans from inside the housing 20. It may also be desirable to be able to obtain access to only one, for example, of a three-fan unit for service, etc., without disturbing the operation of the other fans.

To that end, the present invention contemplates, with particular reference to FIGS. 3 through 3C, 11, 11A and 12 of the drawings, a means, in conjunction with the rotatable feature of turret assembly 40, by which any single fan can be removed for service, maintenance or replacement.

FIGS. 3 and 3A illustrate the swinging arms 59 of the fan removal assembly, which is an integral part of the turret assembly and wherein, in FIG. 3, the arms are shown with the fan in position on the turret substructure 41 and in the operative position whereas the topmost fan in FIG. 3A is shown being moved from that position radially outwardly to its ultimate extended position in FIG. 3B of the drawings whereby it is readily available for repair, maintenance or replacement as required.

Figure 11:
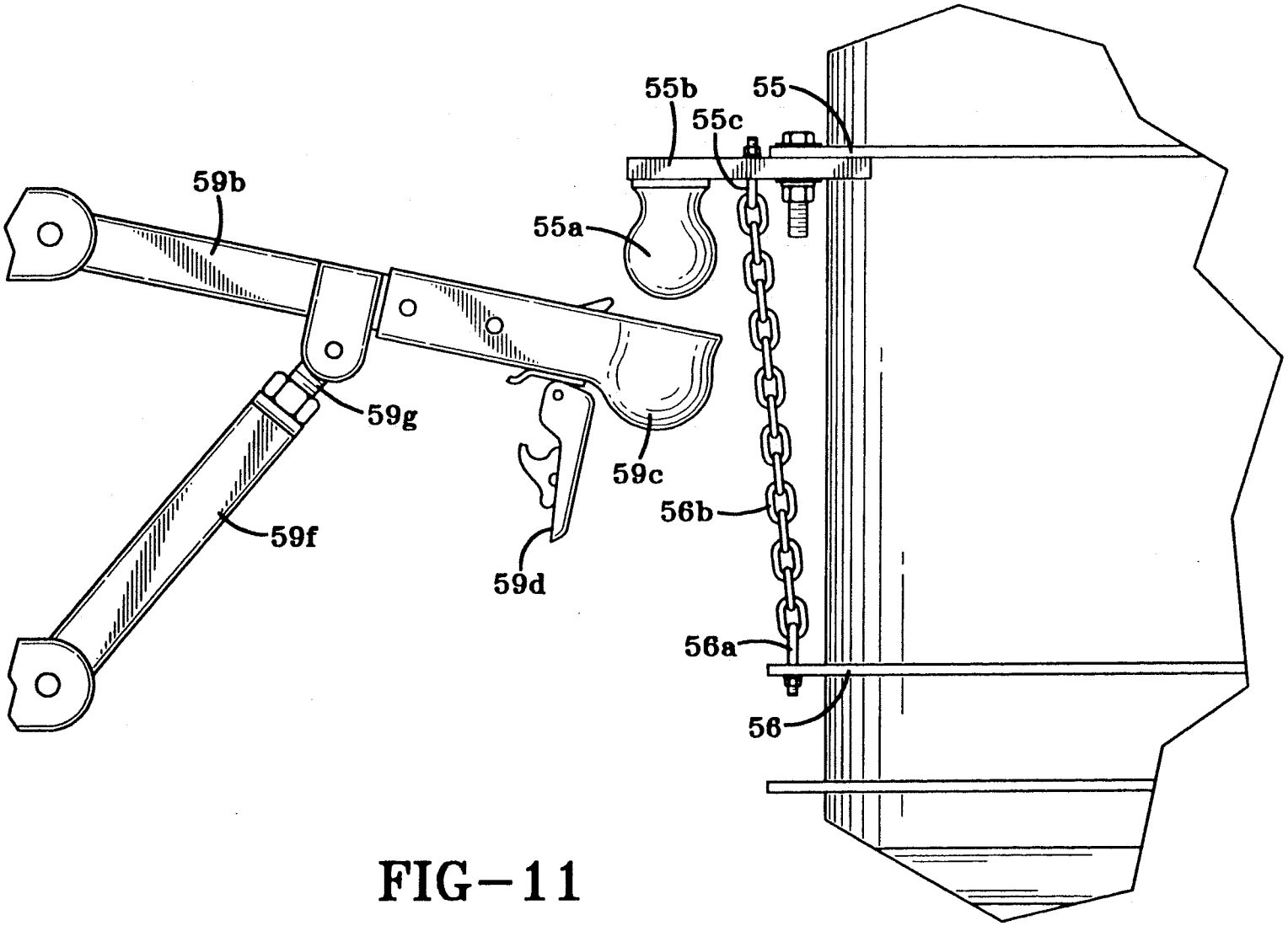
FIG. 11 is an elevational view taken along the line 11—11 of FIG. 3 showing the fan removal apparatus prior to engagement.
Figure 11A:
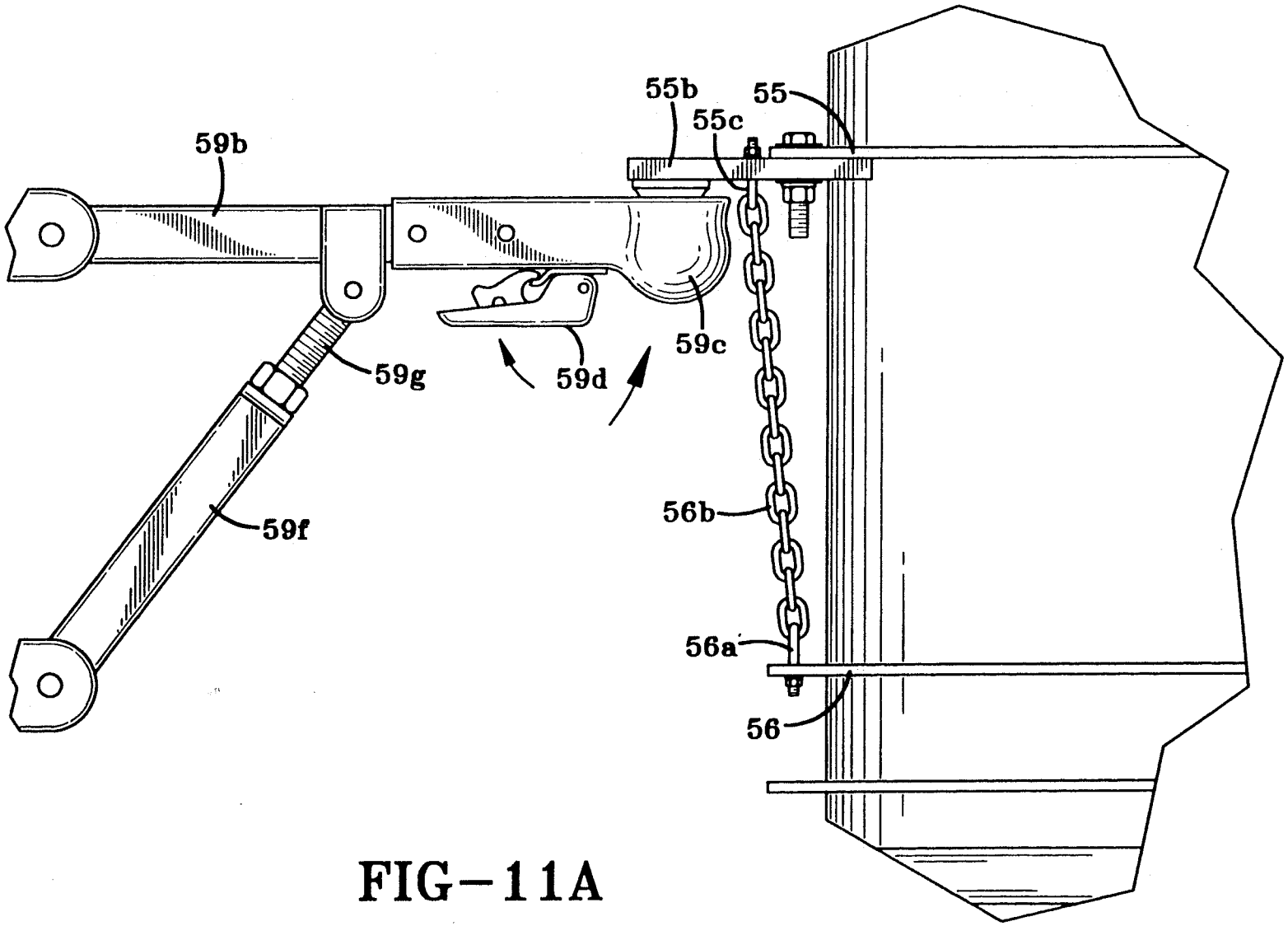
FIG. 11A is a view similar to FIG. 11 showing the fan removal apparatus in connected position.
Figure 12:
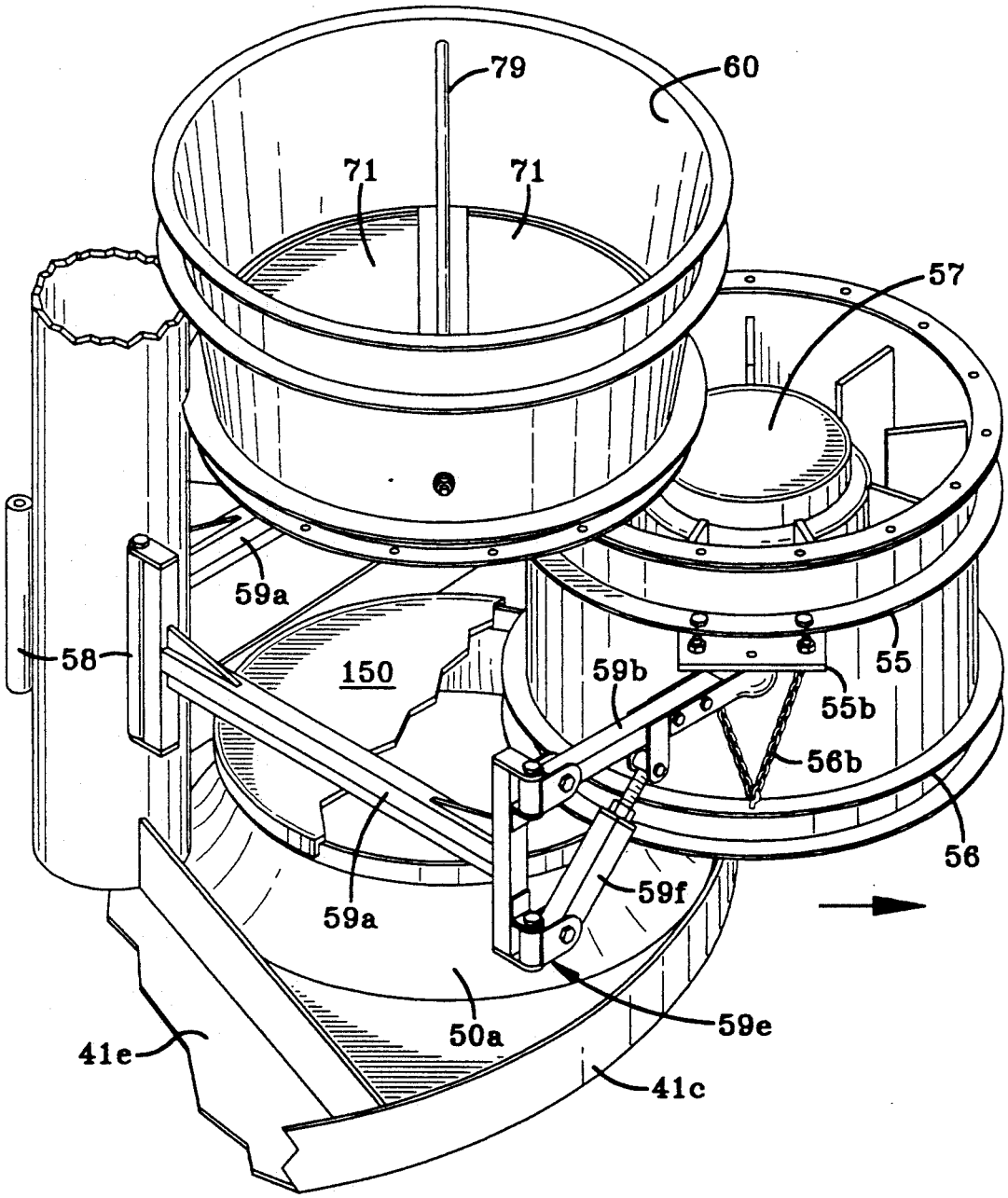
FIG. 12 is an isometric view taken along the line 12—12 of FIG. 3A showing the fan removal apparatus.

As will be seen from the above-referenced drawing figures, each fan housing has an upper fan removal ring 55 and a lower fan removal ring 56 disposed about its outer periphery. FIGS. 11 and 11A of the drawings illustrate an I bolt 56*a* attached to the lower fan removal ring 56 and a ball 55*a*, mounted on a support bracket 55*b*, which ball is similar to a trailer hitch ball, disposed in inverted condition on upper fan removal ring 55. FIGS. 11 through 12 of the drawings illustrate only one of each of these elements, but it will be understood that a pair will be disposed in a diametrically opposed relationship on each fan housing and the two would be provided in each instance, as shown in FIGS. 3 through 3B.

A chain 56*b* interconnects the I bolt 56*a* on lower fan removal ring 56 and the I bolts 55*c* on the ball support bracket 55*b*. The turret sleeve 41*b* of the turret assembly 40 has a number of mounts 58 for receipt of one end of fan removal arms 59, designated by the numeral 59, disposed thereon. The fan removal arms 59 are of the pivoted, elbow type and have a first section 59*a* attached to the mounts 58 and a second section 59*b*, which carries a socket 59*c* and latch 59*d* for engagement with the ball 55*a* which is connected to the support bracket 55*b* of upper fan removal ring 55. Second section 59*b* is also connected to an adjustment arm 59*f*.

As can be seen in FIG. 12, arm sections 59*a* and 59*b* are hingedly interconnected as at 59*e* which permits movement from the FIG. 3 position to the FIG. 3B position in the general direction of arrow 300.

When it is desired to remove a fan, air pressure is removed from the air spring 91 until the turret is dropped down to rest on the turret support 33 such as in the broken line position of FIG. 5. The vertical surface 33*a* of this support also serves to center the turret by engagement with the inner wall of sleeve 41*b*. At that time, the damper assembly 70 is closed in the relevant cone 60, as shown in FIG. 12, and the turret is rotated to locate the selected fan unit 50 at the most accessible place.

After disengaging the fan unit from the inlet bell 50*a*, the arms 59 can then be attached and adjusted by means of the adjustment screw 59*g* on adjustment arm 59*f*, following which the turret may be raised slightly by air spring 91 and the fan unit can be pulled out by extending the arms, as clearly illustrated in FIGS. 3 through 3B and 12 of the drawings.

It is also possible to provide a cover 150 to fit over the top of inlet bell 50*a* when a fan unit is removed. In this way, air leakage from the tower system is prevented on the positive pressure side by damper 70 and on the negative side by cover 150.

The Cowling

As can be appreciated, significant levels of noise are produced when fan units 50 are activated. It is therefore desirable to attenuate this sound and the structure of the present invention facilitates the use of a removable cowling 100 to isolate the breakout sound.

Figure 1B:
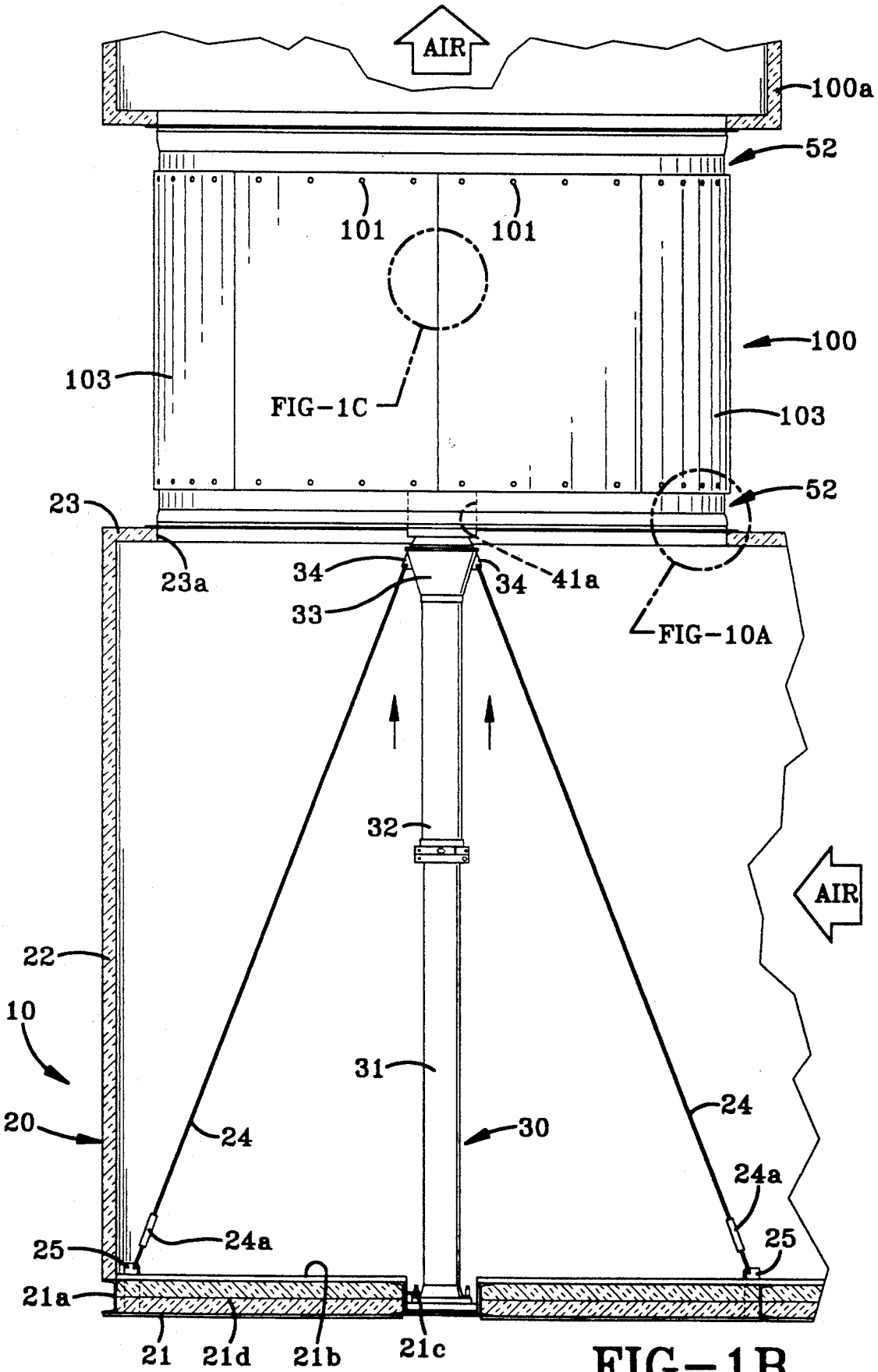
FIG. 1B is a view similar to FIG. 1A showing the sound attenuating cowling in place on the turret.
Figure 1C:
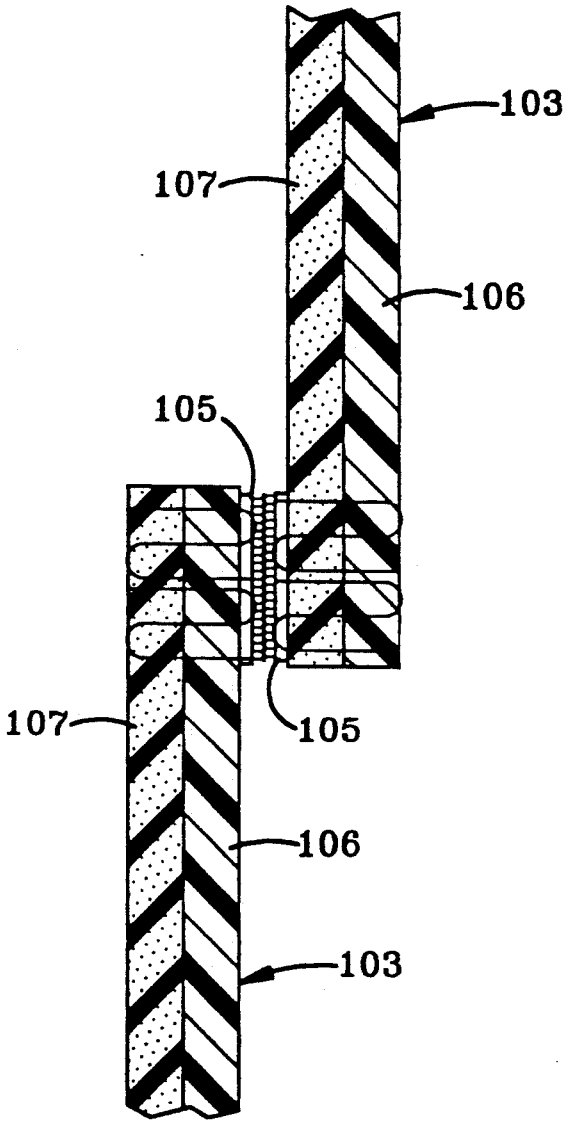
FIG. 1C is a sectional view showing means for sealing sections of the cowling.
Figure 10A:
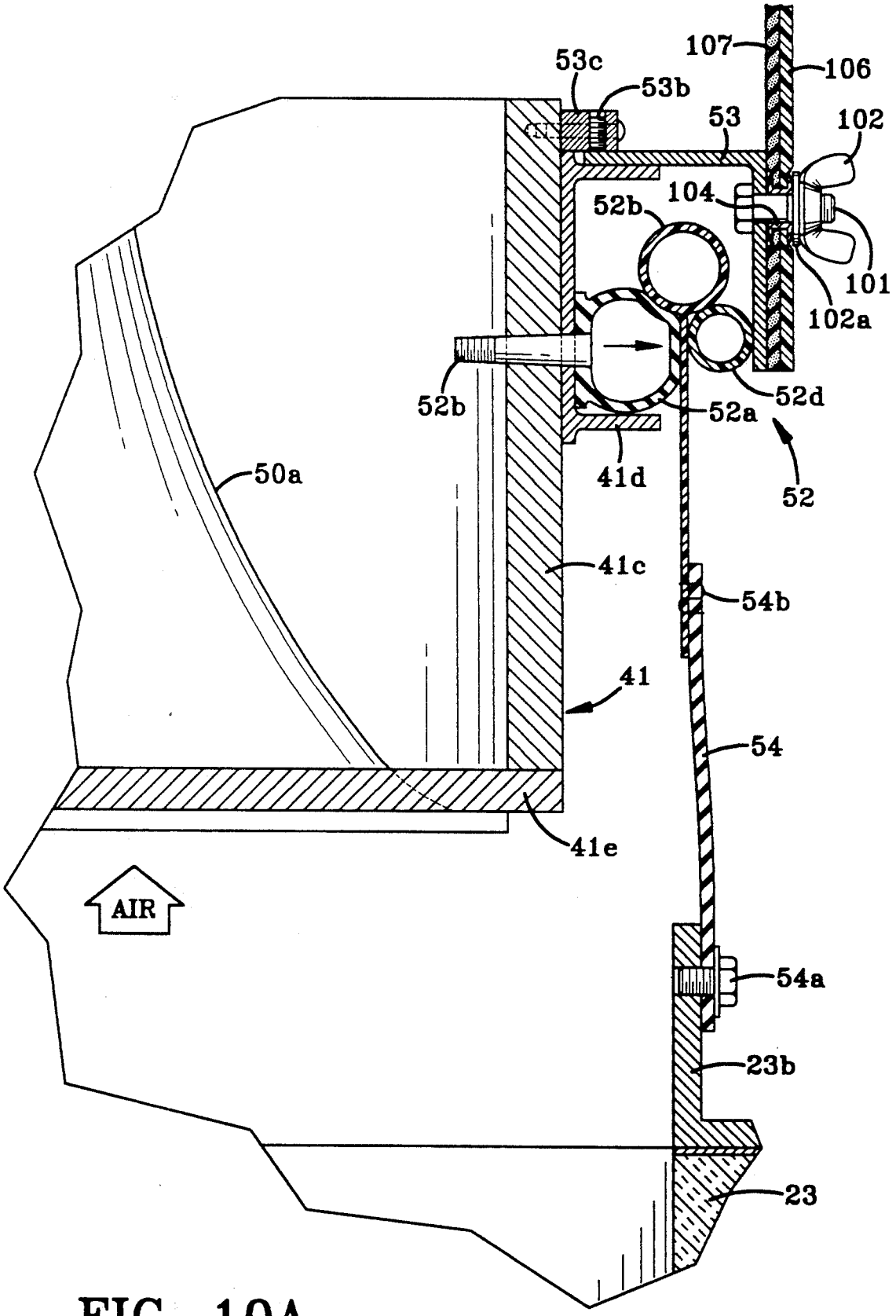
FIG. 10A is a view similar to FIG. 10 showing the isolator means in inflated position.

Referring to FIGS. 1B, 1C and 10A, it will be seen that a series of screws 101,101 can be provided on the edges of the upper and lower substructures for cooperation with wing nuts 102 and washers 102*a*. The cowling itself may take the form of a series of panels 103,103 which have grommets 104,104 spaced along their edges so that they may be received over the projecting ends of screws 101,101 and secured thereto by wing nuts 102,102, as can be clearly seen in FIG. 10A. It will be understood that other fastening expedients such as Velcro® could also be utilized.

As can be seen in FIG. 1C, the edges of adjacent panels 103,103 can be releasably secured to each other by suitable fastening means. The use of Velcro® strips 105,105 is illustrated for purposes of showing a releasable fastening means.

Also, it will be appreciated that the invention is not intended to be limited to a particular material for the panels 103,103. However, clearly a sound deadening construction is desirable and the drawings illustrate a laminate of a vinyl outer layer 106 and an inner foam layer 107 of acoustical material to form a flexible sound transmission barrier.

By use of cowling 100, the breakout sound from the fans can thus be reduced while quick and easy access to the fans is retained.

Installation

In use or operation of the improved turret unit, it will be assumed that the components have been assembled as illustrated in FIG. 1 of the drawings wherein the guy rods 24,24 are in place, the fans 50 are installed, and the entire unit is sealed against contamination. After shipment to the job site, the fan turret unit 10 is located below the upper portion of the tower unit 100*a* and anchored to the floor F by suitable bolts and brackets (not shown). The guy rods 24,24 can then be loosened and the locking collar assembly 37 on the upper and lower column sections 31 and 32 can be removed. If desired, chains and ratchets can be interconnected between guy rod brackets 34 and unit pan assembly 21 to control the column as it is raised.

At this point, the levelling mechanism can be actuated by utilization of studs 35 to level base plate 31*b* relatively of floor F. Column assembly 30 can also be at least preliminarily plumbed by studs 36.

Compressed air is then released into the top section 32 of the column and increased until it overcomes the breakaway friction of the O-rings on piston 31*f*. This causes the upper column section 32 to rise and, along with it, the substructures 41 and 42 of the turret assembly 40 will, of course, rise too inasmuch as the lower substructure 41 rests on turret support 33, until the unit is elevated sufficiently to contact the upper portion of the tower unit 100*a* and be connected thereto. In practice, the turret is raised slightly above its final design height at this time.

It will be noted from FIGS. 3A and 3B that support bolts 38,38 are threaded through sleeve 41*b* and bear against upper column section 32 for stabilizing purposes and can be backed off after installation is completed.

Once this has been accomplished, column assembly 30 can be finally plumbed as previously described. The two-piece collar 37*a* is then reattached at the actual design height and tightened in place, collapsing collet guide 37*b* and collar 37*c*. Air can be relieved and the upper column section 32 is allowed to drop until it rests on the stop formed by collet guide or stop 37*b* and three-piece collar 37*c* is tightened.

At this time, seals 43 and 52 are installed and activated to complete the seal and, following wiring and attachment of cowling 100, the unit is ready for operation.

Operation of the air spring 90 is accomplished by applying air to the air spring until the turret assembly is raised to the operational height above the turret resting support. An operating height control valve (not shown) will maintain the height at the desired level.

Operation of the damper assemblies 70, which are intended to provide a means to stop air flow through non-operating fans or during fan removal with the overall system operating, includes operation of the inclined, wedge-type slide plate assembly suspended by the damper hinge pin at two locations. As previously described, the slide plate 73 has a three-step angular slot milled through it, and two guide bars are mounted on each side. A cylindrical roller is received through the guide bars and the slide plate in the center. When the slide plate 73 is moved, the cylinder-shaped roller moves up or down following the angular slot in the slider and is contained between the guide bars. Connected to the opposite ends of the roller assembly, the adjustable linkages provide the movement path and direction to lock open or closed and lock down the damper blades mounted inside the discharge cone 60.

It will be seen that, by provision of the extendable column assembly 30 carrying the turret assembly 40, the fan turret unit of the invention can be readily assembled and sealed at the factory and quickly assembled on site.

It will also be seen that, by provision of the unique fan removal system, individual fans can be readily and easily removed for maintenance and replacement. Further, it will be apparent that the rotatable turret assembly 40 makes it possible to gain access to selected fans regardless of restricted working space.

It will also be seen that utilization of air spring 91 supporting turret assembly 40, and thus the entire fan array, eliminates the problems of balance often encountered.

It will also be seen that, by sealing the entire turret assembly by flex joints 52, air flow can be greatly improved in contrast to sealing individual fans.

Finally, it will be seen how utilization of the two position damper assembly 70 for each fan minimizes the chance of pressure drops and air leaks.

While a full and complete description of the invention has been set forth in accordance with the dictates of the Patent Statutes, it should be understood that modifications can be resorted to without departing from the spirit hereof or the scope of the appended claims.

Thus, for example, the air spring illustrated in the drawing is of the piston type available from Firestone as in IT15L-4 Airmount® Isolator, but other types, such as convolute, could also be used. The important feature in the principal embodiment of the invention is the utilization of only one isolator as previously mentioned. However, it is contemplated that there may be special circumstances in which more than one may be utilized.

It will also be understood that, while clean rooms have been referred to herein as a desirable environment for the use of the invention, the invention may well have other applications.

Furthermore, while the ability to preassemble the unit of the present invention provides significant advantages, as has been previously mentioned, it will be readily apparent that the unique combination disclosed and claimed herein presents distinct improvements in the art even if field assembled.

What is claimed is:

1. A self-contained fan turret unit for use with a tower air recirculating unit, comprising:

a) a main housing having a bottom wall assembly, opposed side and end walls and a top wall; b) an elongate extendable support column assembly having one end mounted on said bottom wall assembly and movable between fixed, retracted and extended positions;

c) a turret assembly carried on the opposed end of said column assembly;

d) said turret assembly including at least one fan; and e) said turret assembly being movable between a storage position beneath said top wall and an operational position projecting above said top wall upon movement of said column between said retracted and extended positions.

2. The fan turret unit of claim 1 wherein said turret assembly includes at least one discharge cone, at least one inlet bell; at least one mating fan being carried therein.

3. The fan turret unit of claim 2 wherein means are provided for moving said one fan between operative and inoperative positions relative to said turret assembly.

4. The fan turret unit of claim 3 wherein said means for moving said at least one fan includes at least one articulated arm means releasably interconnecting said column assembly and said at least one fan.

5. The fan turret unit of claim 2 wherein said turret assembly includes upper and lower substructures; said at least one discharge cone depends from said upper substructure; and said at least one fan depends from said at least one discharge cone.

6. The fan turret unit of claim 5 wherein a cowling is releasably attached to said upper and lower substructures.

7. The fan turret unit of claim 6 wherein said cowling includes a plurality of panels; and means for releasably securing said panels to each other.

8. The fan turret unit of claim 5 wherein said upper substructure is disposed on said opposed end of said column assembly.

9. The fan turret unit of claim 8 wherein air spring means are received on said opposed end of said column assembly; and said upper substructure is disposed on said air spring means.

10. The fan turret unit of claim 9 wherein said air spring means is rotatably received on said opposed end of said column assembly.

11. The fan turret unit of claim 10 wherein bearing means are disposed on said opposed end of said column assembly; and said air spring means are disposed on said bearing means.

12. The fan turret unit of claim 2 wherein said at least one discharge cone includes a damper assembly.

13. The fan turret unit of claim 12 wherein said damper assembly includes a pair of damper blades movable between open and closed positions whereby said at least one cone may be opened or closed to the passage of air therethrough.

14. The fan turret unit of claim 13 wherein said damper blades have projecting edge surfaces; and sealing means are received on said projecting edge surfaces.

15. The fan turret unit of claim 13 wherein cam means are operatively connected to said damper blades for moving said damper blades between said open and closed positions.

16. The fan turret unit of claim 2 wherein the tower air recirculating unit has a frame disposed above the fan turret unit and sealing means are attached to said turret assembly between said turret assembly and said top wall of said housing and said turret assembly and the frame of the tower air recirculating unit.

17. The fan turret unit of claim 16 wherein said sealing means include an inflatable seal between said turret assembly and said top wall of said housing and between said turret assembly and the frame of the tower air recirculating unit.

18. The fan turret unit of claim 1 wherein levelling means are attached to said one end of said column assembly whereby said column assembly may be adjustably mounted with respect to said bottom wall assembly.

19. The fan turret unit of claim 18 wherein said bottom wall assembly includes a through aperture; and said levelling means are received in said through aperture.

20. The fan turret unit of claim 19 wherein said levelling means include a column support flange attached to said one end of said column assembly; a base plate secured to said bottom wall assembly; and said column support flange being adjustably attached to said base plate.

21. The fan turret unit of claim 20 wherein said levelling means further include a floor engaging footprint plate resiliently attached to said bottom wall assembly; and adjustment means carried by said base plate and adjustably engaging said footprint plate.

22. The fan turret unit of claim 1 wherein air spring means are supported on said opposed end of said column assembly.

23. The fan turret unit of claim 1 wherein said top wall of said housing has a through aperture therein; said turret assembly being extendable through said aperture upon movement of said column assembly to its extended position.

24. The fan turret unit of claim 1 wherein said column assembly includes upper and lower column sections; said lower column section being telescopically received within said upper column section.

25. The fan turret unit of claim 24 wherein locking means are disposed on said upper and lower column sections whereby said upper and lower column sections may be selectively locked against axial movement relatively of each other.

26. The fan turret unit of claim 1 wherein an inflatable seal is disposed between said column assembly and said turret assembly.

27. The fan turret unit of claim 1 wherein bracing means releasably interconnect said bottom wall assembly and said column assembly.

28. The fan turret unit of claim 1 wherein a cowling is releasably attached to said turret assembly in peripherally encircling relationship therewith.

29. The fan turret unit of claim 28 wherein said cowling includes a plurality of panels; and means for releasably securing said panels to each other.

30. A self-contained fan turret unit for use with a tower air recirculating unit, comprising:

a) a main housing having a bottom wall assembly; opposed side and end walls secured to and projecting from said bottom wall assembly and a top wall assembly secured to the projecting edges of said side walls;

b) a support column assembly having a first end mounted on said bottom wall assembly and a second end moveable between retracted and extended positions;

c) a turret assembly supported on said second end of said column assembly and movable therewith from a position beneath said top wall assembly and one above said top wall assembly;

d) said turret assembly including at least one discharge cone, at least one inlet bell and at least one mating fan attachable to said at least one discharge cone and said at least one inlet bell;

e) damper means carried within said at least one cone;

f) air spring means rotatably mounted on said second end of said column assembly and supporting said turret assembly; and g) means for moving said at least one fan from an operative position on said turret assembly to an inoperative position with respect thereto.

31. A damper assembly for use within a flared discharge cone of a fan, comprising:

a) a pair of damper blades pivotally connected to the cone and movable between open and closed positions;

b) externally mounted actuating means operatively connected to said damper blades;

c) cam means carried by the cone and operatively connected to said damper blades and said externally mounted actuating means for moving said damper blades between said open and closed positions;

d) said damper blades have projecting edge surfaces configured complementally with the configuration of the cone; and e) a flexible seal attached to said projecting edge surfaces.

32. The damper assembly of claim 31 wherein said seal has opposed legs receivable on said projecting edge surfaces; and a bulbous nose projecting radially outwardly therefrom.

33. A fan turret unit, comprising:

a) an elongate extendable support column assembly;

b) a turret assembly rotatably mounted on a first end of said support column assembly;

c) said turret assembly including at least one discharge cone, at least one inlet bell and at least one mating fan; and d) air spring means supported on said first end of said support column assembly in supporting engagement with said turret assembly.

34. The fan turret unit of claim 33 wherein levelling means are carried by a second, opposed end of said support column assembly.

35. The fan turret unit of claim 33 wherein bearing means are disposed on said first end of said support column assembly; and said air spring means are disposed on said bearing means.

36. The fan turret unit of claim 33 wherein a damper assembly is carried by said one discharge cone.

37. The fan turret unit of claim 33 wherein fan removal means are provided on said turret assembly for moving said one fan between operative and inoperative positions relatively thereof.

38. The fan turret unit of claim 33 wherein a cowling is releasably attached to said fan turret assembly in peripherally covering relationship thereto.

39. A self-contained fan turret unit for use with a tower air recirculating unit, comprising:

a) a main housing having a bottom wall assembly, opposed side and end walls and a top wall;

b) an elongate extendable support column assembly having one end mounted on said bottom wall assembly and movable between retracted and extended positions;

c) a turret assembly carried on the opposed end of said column assembly;

d) said turret assembly being movable between a position beneath said top wall and a position projecting above said top wall upon movement of said column assembly between said retracted and extended positions; and e) said turret assembly including 1) at least one discharge cone, 2) at least one inlet bell, and 3) at least one mating fan carried thereon.

40. The fan turret unit of claim 39 wherein air spring means are supported on said opposed end of said column assembly.

41. The fan turret unit of claim 39 wherein means are provided for moving said one fan between operative and inoperative positions relative to said turret assembly.

42. The fan turret unit of claim 41 wherein said means for moving said at least one fan includes at least one articulated arm means releasably interconnecting said column assembly and said at least one fan.

43. The fan turret unit of claim 39 wherein levelling means are attached to said one end of said column assembly whereby said column assembly may be adjustably mounted with respect to said bottom wall assembly; said bottom wall assembly includes a through aperture; and said levelling means are received in said through aperture.

44. The fan turret unit of claim 43 wherein said levelling means include a column support flange attached to said one end of said column assembly; a base plate secured to said bottom wall assembly; and said column support flange being adjustably attached to said base plate.

45. The fan turret unit of claim 44 wherein said levelling means further include a floor engaging footprint plate resiliently attached to said bottom wall assembly; and adjustment means carried by said base plate and adjustably engaging said footprint plate.

46. The fan turret unit of claim 39 wherein an inflatable seal is disposed between said column assembly and said turret assembly.

47. The fan turret unit of claim 39 wherein said turret assembly includes upper and lower substructures; said at least one discharge cone depends from said upper substructure; and said at least one fan depends from said at least one discharge cone.

48. The fan turret unit of claim 47 wherein a cowling is releasably attached to said upper and lower substructures.

49. The fan turret unit of claim 48 wherein said cowling includes a plurality of panels; and means for releasably securing said panels to each other.

50. The fan turret unit of claim 47 wherein said upper substructure is disposed on said opposed end of said column assembly.

51. The fan turret unit of claim 50 wherein air spring means are received on said opposed end of said column assembly; and said upper substructure is disposed on said air spring means.

52. The fan turret unit of claim 51 wherein said air spring means is rotatably received on said opposed end of said column assembly.

53. The fan turret unit of claim 52 wherein bearing means are disposed on said opposed end of said column assembly; and said air spring means are disposed on said bearing means.

54. The fan turret unit of claim 39 wherein a cowling is releasably attached to said turret assembly in peripherally encircling relationship therewith; said cowling includes a plurality of panels; and means are provided for releasably securing said panels to each other.

55. The fan turret unit of claim 39 wherein said at least one discharge cone includes a damper assembly.

56. The fan turret unit of claim 55 wherein said damper assembly includes a pair of damper blades movable between open and closed positions whereby said at least one cone may be opened or closed to the passage of air therethrough.

57. The fan turret unit of claim 56 wherein said damper blades have projecting edge surfaces; and sealing means are received on said projecting edge surfaces.

58. The fan turret unit of claim 56 wherein cam means are operatively connected to said damper blades for moving said damper blades between said open and closed positions.

59. The fan turret unit of claim 39 wherein the tower air recirculating unit has a frame disposed above the fan turret unit and sealing means are attached to said turret assembly between said turret assembly and said top wall of said housing and said turret assembly and the frame of the tower air recirculating unit.

60. The fan turret unit of claim 59 wherein said sealing means include an inflatable seal between said turret assembly and said top wall of said housing and between said turret assembly and the frame of the tower air recirculating unit.

61. A damper assembly for use within a flared discharge cone of a fan, comprising:

a) a pair of damper blades pivotally connected to the cone and movable between open and closed positions;

b) cam means carried by the cone and operatively connected to said damper blades for moving said damper blades between open and closed positions;

c) said damper blades having projecting edge surfaces configured complementally with the configuration of the cone; and d) a flexible seal attached to said projecting edge surfaces.

62. The damper assembly of claim 61 wherein said seal has opposed legs receivable on said projecting edge surfaces; and a bulbous nose projecting radially outwardly therefrom.

* * * * *

UNITED STATES PATENT AND TRADEMARK OFFICE

CERTIFICATE OF CORRECTION

PATENT NO. : 5,230,604

DATED : July 27, 1993

INVENTOR(S) : Donald L. Glaser et al.

It is certified that error appears in the above-identified patent and that said Letters Patent is hereby corrected as shown below:

In Column 5, line 38, delete "gate" and substitute therefor ---grate---.

In Column 7, line 12, delete "collect" and substitute therefor ---collet---.

In Column 7, line 15, delete "collect" and substitute therefor ---collet---.

Signed and Sealed this

Fifth Day of April, 1994

Bruce Lehman

*Attest:*

BRUCE LEHMAN

*Attesting Officer*

*Commissioner of Patents and Trademarks*